US008688442B2

(12) United States Patent
Miyasaka et al.

(10) Patent No.: US 8,688,442 B2
(45) Date of Patent: Apr. 1, 2014

(54) AUDIO DECODING APPARATUS, AUDIO CODING APPARATUS, AND SYSTEM COMPRISING THE APPARATUSES

(75) Inventors: Shuji Miyasaka, Osaka (JP); Kosuke Nishio, Osaka (JP); Takeshi Norimatsu, Hyogo (JP)

(73) Assignee: Panasonic Corporation, Osaka (JP)

( * ) Notice: Subject to any disclaimer, the term of this patent is extended or adjusted under 35 U.S.C. 154(b) by 101 days.

(21) Appl. No.: 13/433,063

(22) Filed: Mar. 28, 2012

(65) Prior Publication Data

US 2012/0185241 A1 Jul. 19, 2012

Related U.S. Application Data

(63) Continuation of application No. PCT/JP2010/004728, filed on Jul. 23, 2010.

(30) Foreign Application Priority Data

Sep. 30, 2009 (JP) ..... 2009-228953

(51) Int. Cl.
*G10L 19/02* (2013.01)

(52) U.S. Cl.
USPC ..... 704/229; 704/200; 704/500; 704/501

(58) Field of Classification Search
USPC ..... 704/200–201, 229, 500–502
See application file for complete search history.

(56) References Cited

U.S. PATENT DOCUMENTS

| | | | | |
|---|---|---|---|---|
| 5,890,108 | A * | 3/1999 | Yeldener | 704/208 |
| 6,658,383 | B2 * | 12/2003 | Koishida et al. | 704/229 |
| 7,058,574 | B2 | 6/2006 | Taniguchi et al. | |
| 7,529,660 | B2 * | 5/2009 | Bessette et al. | 704/205 |
| 7,788,105 | B2 | 8/2010 | Miseki | |
| 2001/0041976 | A1 | 11/2001 | Taniguchi | |
| 2005/0096904 | A1 | 5/2005 | Taniguchi | |
| 2006/0020450 | A1 | 1/2006 | Miseki | |
| 2009/0030678 | A1 | 1/2009 | Kovesi et al. | |
| 2010/0250245 | A1 | 9/2010 | Miseki | |
| 2010/0250262 | A1 | 9/2010 | Miseki | |
| 2010/0250263 | A1 | 9/2010 | Miseki | |

FOREIGN PATENT DOCUMENTS

| | | | |
|---|---|---|---|
| CN | 101281749 | A | 10/2008 |
| JP | 62-123843 | A | 6/1987 |
| JP | 02-123400 | A | 5/1990 |
| JP | 2000-267699 | A | 9/2000 |
| JP | 3189614 | B2 | 7/2001 |
| JP | 2001-318694 | A | 11/2001 |

(Continued)

OTHER PUBLICATIONS

Chinese Office Action issued in Chinese Patent Application No. 201080043418.0 mailed Dec. 5, 2012.

(Continued)

*Primary Examiner* — Douglas Godbold

(74) *Attorney, Agent, or Firm* — McDermott Will & Emery LLP

(57) ABSTRACT

An audio decoding apparatus comprises: a plurality of decoding units; a band replicating unit which processes a decoded signal obtained when a corresponding decoding unit decodes a coded signal, according to a scheme specified by transmitted information; and an information transmitting unit which transmits, to a signal processing unit, information identifying the corresponding decoding unit from among the plurality of decoding units.

12 Claims, 10 Drawing Sheets

(56) References Cited

FOREIGN PATENT DOCUMENTS

| | | | |
|---|---|---|---|
| JP | 2002-301066 | A | 10/2002 |
| JP | 2005-258226 | A | 9/2005 |
| JP | 2008-139623 | A | 6/2008 |
| JP | 2009-527785 | A | 7/2009 |
| WO | WO 2007/096551 | A2 | 8/2007 |

OTHER PUBLICATIONS

"3GPP TS 26.090 V9.0.0 , Adaptive Multi-Rate (AMR) speech codec; Transcoding functions", 3GPP, Dec. 2009.

"ISO/IEC 13818-7:2004, Information technology—Generic coding of moving pictures and associated audio information:—Part 7: Advanced Audio Coding (AAC)", Oct. 15, 2004.

"ISO/IEC 13818-7:2003 (MPEG-2 AAC, Second Edition)", Dec. 2002.

Shoji Makino et al., "Subband Echo Canceller with an Exponentially Weighted Stepsize NLMS Adaptive Filter", Journal of the Institute of Electronics, Information and Communication Engineers (IEICE), A, vol. J79-A, No. 6, pp. 1138-1146, Jun. 1996, with partial English translation.

"ISO/IEC JTC1/SC29/WG11 N10661 (WD3 of USAC)", Apr. 2009.

International Search Report issued in International Patent Application No. PCT/JP2010/004728, dated Oct. 19, 2010.

* cited by examiner

| Profile | Bit rate | Audio | A/S | Speech |
|---|---|---|---|---|
| Voice conversation Profile | 4 kbps | Unavailable | Unavailable | Available |
| AV Com Profile | 12 kbps | Available | Available | Available |
| Mobile TV Profile | 24 kbps | Available | Available | Unavailable |
| TV Profile | 48 kbps | Available | Unavailable | Unavailable |

AUDIO DECODING APPARATUS, AUDIO CODING APPARATUS, AND SYSTEM COMPRISING THE APPARATUSES

CROSS REFERENCE TO RELATED APPLICATIONS

This is a continuation application of PCT Patent Application No. PCT/JP2010/004728 filed on Jul. 23, 2010, designating the United States of America, which is based on and claims priority of Japanese Patent Application No. 2009-228953 filed on Sep. 30, 2009. The entire disclosures of the above-identified applications, including the specifications, drawings and claims are incorporated herein by reference in their entirety.

TECHNICAL FIELD

The present invention relates to audio coding apparatuses and audio decoding apparatuses which can achieve a high sound quality with a low bit rate. In particular, the present invention relates to an audio coding apparatus and an audio decoding apparatus which can achieve a high sound quality even in the cases where an input signal is a voice signal (a human voice) and where an input signal is a non-voice signal (musical sound, natural sound, or the like).

BACKGROUND ART

A coding scheme used for conversation using a mobile phone or the like is a scheme called Code-Excited Linear Prediction (CELP) Codec. More specifically, the coding scheme for use is a scheme for separating an input signal into a linear prediction coefficient and an excitation signal (which is a signal to be an input to a linear prediction filter using the linear prediction coefficient), and coding each of the data resulting from the separation. Examples of such a coding scheme include an adaptive multi-rate (AMR) scheme (see Non-patent Literature 1). This scheme performs modeling of an acoustic characteristic of a vocal tract using a linear prediction coefficient and performs modeling of vibration of a vocal band using an excitation signal. For this reason, it is possible to efficiently code speech signals, but it is impossible to efficiently code signals of natural sounds (audio signals) which are non-speech signals and thus for which no such modeling is performed.

On the other hand, examples of a coding scheme used for a digital television (TV), a Digital Versatile Disc (DVD), or a Blue-ray disc player include a scheme such as the Advanced Audio Coding (AAC) scheme (see Non-patent Literature 2). This scheme is a scheme for coding a raw frequency spectrum of an input signal. For this reason, this scheme cannot enable compression of a speech signal at a compression rate as high as a compression rate obtainable in the CELP Codec although this scheme can provide a natural sound (a non-speech audio signal) having a good sound quality.

This is described qualitatively using a graph of FIG. 11.

In the graph of FIG. 11, the horizontal axis shows bit rates in coding, and the vertical axis shows sound quality. The solid curve (data 73) shows the relationship between bit rates and sound quality in an audio codec such as AAC (in the case where a scheme for audio is used). A curve represented as an alternate long and short dash line (data 74S) shows the relationship between the bit rates and the sound quality in a speech codec such as AMR (in the case where a scheme for speech is used). A curve represented as a broken line shows the relationship between bit rates and sound quality in the case where a signal that is non-speech signal is processed according to a speech codec. Here, various kinds of units are considered to be appropriate for the horizontal axis and the vertical axis in the graph of FIG. 11. In other words, for example, such units may be considered as arbitrary units. More specifically, for example, the unit used for the vertical axis may indicate values evaluated using a human sense in an experiment. In addition, the unit used for the horizontal axis may indicate values represented using kbps (kilobit per second).

Here, a range 90 enclosed by a thin broken line in the vertical direction in the diagram shows the range of bit rates in which an appropriate coding unit is different depending on an input signal. A detailed description of bit rates is given later.

In the operation of standardizing the United Speech and Audio Codec (SAC) described in detail later, only the range 90 is focused on, and a range (range 91) other than the range 90 is not focused so much. Sound qualities depend on kinds of input signals (signals to be coded). Within the range 90, a speech codec can achieve a better sound quality (see data 74S and data 73) in the case where an input signal is a speech signal. On the other hand, within the range 90, an audio codec can achieve a better sound quality (see data 73 and data 74A) in the case where an input signal is a non-speech signal.

As such, in the recent activity for standardizing audio standards by MPEG, a consideration is given of a coding standard (the Unified Speech and Audio codec (USAC)) which enables efficient coding of both the speech signals and natural sounds (non-speech audio signals).

FIG. 9 shows a schematic block diagram of coding.

A plurality of blocks shown in the block diagram of FIG. 9 includes: an input signal classifying unit 500 which classifies input signals (signals to be coded) into a signal for which a speech codec is suitable or a signal for which an audio codec is suitable before coding the input signals; a high frequency signal coding unit 501 which codes high frequency components of the input signals; an audio signal coding unit 502; a speech signal coding unit 503; and a bit stream generating unit 504.

As shown in FIG. 9, the input signal classifying unit 500 classifies the input signals into the signal for which the speech codec is suitable or the signal for which the audio codec is suitable. After such classification is performed, each of the input signals is coded by a coding unit (an audio signal coding unit 502 or a speech signal coding unit 503) corresponding to the kind of the suitable one of the speech codec and the audio codec. Here, the high-frequency signal coding unit 501 prepared at a pre-stage performs coding of a Spectral Band Replication (SBR) technique (ISO/IEC11496-3) standardized by the Moving Picture Experts Group (MPEG), and thereby contributes to replication of a reproduction band at the time of decoding.

FIG. 10 shows a block diagram of decoding according to USAC.

A plurality of blocks shown in the block diagram of FIG. 10 includes: a bit stream separating unit 600 which separates a bit stream of an input into a coded signal; an audio signal decoding unit 601; a speech signal decoding unit 602; and a band replicating unit 603 which replicates a reproduction band of a signal decoded by one of the decoding units.

As shown in FIG. 10, the bit stream of the input is separated into the coded signal by the bit stream separating unit 600. In the case where the coded signal is classified as a coded signal of an audio signal, the coded signal is processed by the audio signal decoding unit 601. In the opposite case where the coded signal is classified as a coded signal of a speech signal, the coded signal is processed by the speech signal decoding unit 602. In this way, a Pulse Code Modulation (PCM) signal is generated. The decoded signal in any one of the cases is subjected to a reproduction band replication process performed by the band replicating unit 603.

CITATION LIST

Non Patent Literature

[NPL 1]
3GPP TS 26.090, Adaptive Multi-Rate (AMR) speech codec; Transcoding functions
[NPL 2]
ISO/IEC 13818-7:2003, Information technology—Generic coding of moving pictures and associated audio information:—Part 7: Advanced Audio Coding (AAC)

SUMMARY OF INVENTION

Technical Problem

However, although the conventional apparatus configured as described above makes it possible to make an analysis of a property of a signal to be coded and a determination on whether the signal is a speech signal or an audio signal, the conventional apparatus does not include any means for transmitting the determined information to a signal processing unit (for example, the band replicating unit 603 in the case of FIG. 10) which performs a post-process of decoding (a post-decoding process). This prevents the signal processing unit from executing an optimum process. In other words, since the information is not transmitted, it is impossible to perform a comparatively appropriate post-decoding process by using the information. Thus, an inappropriate post-decoding process is inevitably performed.

The present invention has been made in view of the conventional problem, with an aim to provide an audio decoding apparatus which generates an optimum (more appropriate) decoded signal (processed signal) according to a property of the coded signal of an input.

Solution to Problem

In order to solve the aforementioned problem, an audio decoding apparatus according to an aspect (A1) of the present invention is an audio decoding apparatus which decodes a coded signal generated using a coding scheme suitable for an input signal, the coding scheme being selected from among a plurality of coding schemes according to a property of the input signal, the audio decoding apparatus comprising: a plurality of decoding units each of which is configured to perform a decoding scheme paired with a corresponding one of the coding schemes, and decodes the coded signal when the decoding unit is a corresponding decoding unit that performs the decoding scheme paired with the coding scheme used to generate the coded signal; a signal processing unit configured to process a decoded signal generated from the coded signal by the corresponding decoding unit, using one of schemes which is identified by information as being suitable for the decoded signal, the information being transmitted to the signal processing unit; and an information transmitting unit configured to transmit, to the signal processing unit, the information identifying the corresponding decoding unit from among the decoding units.

Here, the information may be information in, for example, a publicly known technique.

In this way, such information is transmitted and used when performing such a post-decoding process according to a more appropriate scheme (for example, the scheme in Japanese Patent Publication No. 3189614) corresponding to the decoding unit (a corresponding decoding unit) specified based on the transmitted information. In this way, it is possible to generate a more appropriate signal (a second processed signal having a higher quality) as a processed signal generated in the post-decoding process.

Furthermore, since such information for identifying the corresponding decoding unit is simply used and thus no additional information is necessary, it is possible to configure the audio decoding apparatus to have a simple structure.

In this way, it is possible to achieve both processed signals having a high quality and the audio decoding apparatus having the simple structure.

In addition, an audio coding apparatus according to an aspect (A2) of the present invention is an audio coding apparatus comprising: a plurality of coding units; a signal classifying unit which determines a classification of a property of an input signal as a classification of the input signal, according to the property: and a selecting unit which selects a coding unit for use corresponding to the classification determined by the signal classifying unit and an index specified for the selecting unit from among the plurality of coding units, according to the classification and the index, and causes the selected coding unit for use to code the input signal.

An audio signal processing system according to an aspect (A3) of the present invention is an audio signal processing system comprising the audio decoding apparatus according to the aspect (A1) and the audio coding apparatus according to the aspect (A2), conforming to the Unified Speech and Audio Codec (USAC) (see FIG. 5 etc.).

In other words, in the audio signal processing system, an audio coding apparatus may be included in addition to the audio coding apparatus (see FIG. 5 etc.)

In this way, an index is specified for the selecting unit. Here is a case where a specified index (a bit rate shown by the specified index, (see the horizontal axis of the graph of FIG. 11)) is within a predetermined range (see the range 91*a*) even when the amount of a speech component is comparatively small (for example, see (1) in FIG. 11). In this case, the audio coding apparatus performs coding according to a scheme (a scheme in a speech codec) for generating a second processed signal more appropriate than a first processed signal, and the audio decoding apparatus generates the second processed signal. In this way, in more cases, it is possible to generate such a more appropriate second processed signal in a more reliable manner.

Furthermore, in the case where a bit rate shown by a specified index is outside the range (for example, see the range 90), no coding according to the scheme (the scheme in the speech codec) is performed, and thus a high sound quality is maintained (see the sound quality of data 74A and 73 within the range 90).

In this way, it is possible to reliably generate an appropriate second processed signal, and maintain a high sound quality.

Here, it is possible that, at a certain time point, the audio coding apparatus is included in an audio signal processing system and is present together with other components (an audio decoding apparatus etc.) in the audio signal processing system. In addition, at another time point, it is possible that the audio coding apparatus is excluded from the audio signal processing system, and is present independently from the other components in the system (see the above aspect (A2)).

In this way, in the case where a coded signal is a signal according to a certain coding scheme (a coded signal according to a speech codec), the audio decoding apparatus in the audio signal processing system performs a process (for example, band replication) on the decoded signal according to a scheme which can achieve a higher quality (for example, with a high accuracy). The audio coding apparatus selects a coding unit corresponding to the index (the coding unit in the speech codec within the range 91*a*) even for a classification in a certain range (for example, see (1) in FIG. 11). Thus, in many cases, it is possible to select the coding unit which supports the certain coding scheme, and reliably perform an appropriate process which can provide a high quality.

The audio decoding apparatus according to the aspect (A1) and the audio decoding apparatus according to the aspect (A2) are used as two components of the audio signal processing system according to the aspect (A3).

An audio decoding apparatus according to an aspect (B1) of the present invention is an audio decoding apparatus which selects an appropriate one of coding schemes according to a property of an input signal, and decodes a bit stream coded according to the selected coding scheme, and the audio decoding apparatus comprises: a decoding unit group composed of a plurality of decoding units corresponding to coding schemes selectable in coding; a signal processing unit which processes an output signal of the decoding unit paired with the coding scheme; an information transmitting unit which transmits, to the signal processing unit, information indicating which one of the decoding units in the decoding unit group is used, wherein the signal processing unit processes the signal using a scheme which is different according to the information from the information transmitting unit.

In an aspect (B2) of the present invention, in the audio decoding apparatus according to the aspect (B1), the decoding units include a first decoding unit configured to decode a bit stream in the case where the bit stream is a bit stream generated by coding a frequency spectrum signal of the input signal; and a second decoding unit configured to decode the bit stream in the case where the bit stream is a bit stream generated by coding a linear prediction coefficient and an excitation signal of the input signal, wherein the signal processing unit is configured to replicate a reproduction band of the decoded signal generated by the corresponding decoding unit, and replicate a reproduction band of the decoded signal generated by the second decoding unit according to an envelope characteristic of a frequency calculated based on the linear prediction coefficient.

In an aspect (B3) of the present invention, in the audio decoding apparatus according to the aspect (B1), the decoding units include: a first decoding unit configured to decode the bit stream generated by coding a frequency spectrum signal of the input signal; and a second decoding unit configured to decode the bit stream generated by coding a linear prediction coefficient and an excitation signal of the input signal, and wherein the signal processing unit is configured to enhance a voice in a voice bandwidth in the decoded signal generated by the second decoding unit.

An audio coding apparatus according to an aspect (B4) of the present invention comprising: a plurality of coding units respectively assigned with numbers from first to Nth (N>1) indicating the ranks of the coding units; a signal classifying unit configured to determine a classification of a property of an input signal as a classification of the input signal, according to the property; and a selecting unit configured to select, from among the coding units, a coding unit for use according to the output by the signal classifying unit and an index specified in advance.

In an aspect (B5) of the present invention, in the audio coding apparatus according to the aspect (B4), the coding unit ranked first is configured to code a frequency spectrum signal of the input signal, and the coding unit ranked Nth is configured to separate the input signal into a linear prediction coefficient and an excitation signal, and code each of the linear prediction coefficient and the excitation signal.

In an aspect (B6) of the present invention, in the audio coding apparatus according to the aspect (B4), the coding unit ranked first is configured to code a frequency spectrum signal of the input signal, the coding unit ranked Nth is configured to separate the input signal into a linear prediction coefficient and an excitation signal, and code each of the linear prediction coefficient and a temporal axis signal of the excitation signal, and the coding unit ranked Mth (1<M<N) is configured to separate the input signal into a linear prediction coefficient and an excitation signal, and code each of the linear prediction coefficient and a frequency axis signal of the excitation signal.

In an aspect (B7) of the present invention, in the audio coding apparatus according to the aspect (B4), the index indicates a bit rate in the coding, and the selecting unit is configured to select one of the coding units which is ranked higher more frequently when the bit rate is higher than when the bit rate is lower.

In an aspect (B8) of the present invention, in the audio coding apparatus according to the aspect (B4), the index indicates an application of a coded signal, and the selecting unit is configured to select one of the coding units which is ranked higher less frequently in the case where the application indicated by the index involves voice conversation than in the opposite case.

Advantageous Effects of Invention

The present invention makes it possible to process a decoded signal according to an appropriate scheme. In addition, the present invention makes it possible to reliably perform coding according to an appropriate coding scheme, and to thereby reliably execute an appropriate post-decoding process.

In other words, with a simply-configured audio decoding apparatus according to the present invention, it is possible to increase the quality of the processed signal. Furthermore, it is possible to reliably maintain a high sound quality, not only to increase the quality of the processed signal.

The audio decoding apparatus according to the aspect (B1) is capable of obtaining the optimum decoded signal according to the property of the input bit stream.

The audio decoding apparatus according to the aspect (B2) is capable of replicating the reproduction band according to the optimum scheme in the case where the input bit stream is the coded stream of a speech signal.

The audio decoding apparatus according to the aspect (B3) is capable of performing the enhancement process on the voice bandwidth according to the optimum scheme in the case where the input bit stream is the coded stream of the speech signal.

The audio coding apparatus according to the aspect (B4) is capable of selecting the optimum coding unit according to the property of the input signal and the pre-specified index.

The audio coding apparatus according to the aspect (B5) is capable of selecting the optimum coding unit and achieving the high sound quality irrespective of whether the input signal is the speech signal or an audio signal.

The audio coding apparatus according to the aspect (B6) is capable of selecting the optimum coding unit and achieving the high sound quality irrespective of whether the input signal is the speech signal, an audio signal, or a signal which is a mixture of the speech and audio signals.

The audio coding apparatus according to the aspect (B7) is capable of selecting the optimum coding unit and achieving the high sound quality according to the bit rate, irrespective of whether the input signal is the speech signal or an audio signal.

The audio coding apparatus according to the aspect (B8) is capable of selecting the optimum coding unit and achieving the high sound quality according to the application, irrespective of whether the input signal is the speech signal or the audio signal.

BRIEF DESCRIPTION OF DRAWINGS

These and other objects, advantages and features of the invention will become apparent from the following description thereof taken in conjunction with the accompanying drawings that illustrate a specific embodiment of the present invention. In the Drawings:

FIG. 1 is a diagram showing a structure of an audio decoding apparatus according to Embodiment 1 of the present invention;

FIG. 2 is a diagram showing a structure of an audio decoding apparatus according to Embodiment 1;

FIG. 3 is a diagram showing a structure of an audio coding apparatus according to Embodiment 2 of the present invention;

FIG. 4 is a diagram showing a structure of an audio coding apparatus according to Embodiment 2;

FIG. 5 is a diagram showing an audio signal processing system according to the present invention;

FIG. 6 is a diagram showing an audio coding apparatus according to the present invention;

FIG. 7 is a structural diagram of a communication system to which the present invention is applied;

FIG. 8 is a structural diagram showing an inside of an echo canceling unit.

FIG. 9 is a diagram showing a structure of an audio decoding apparatus according to a conventional technique;

FIG. 10 is a diagram showing a structure of an audio coding apparatus according to a conventional technique;

FIG. 11 is a diagram showing a tendency between bit rates and sound quality in each of coding schemes according to the present invention; and

FIG. 12 is a flowchart showing a flow of processes in each of the embodiments of the present invention.

DESCRIPTION OF EMBODIMENTS

Hereinafter, embodiments are described with reference to the drawings.

Figure 1:
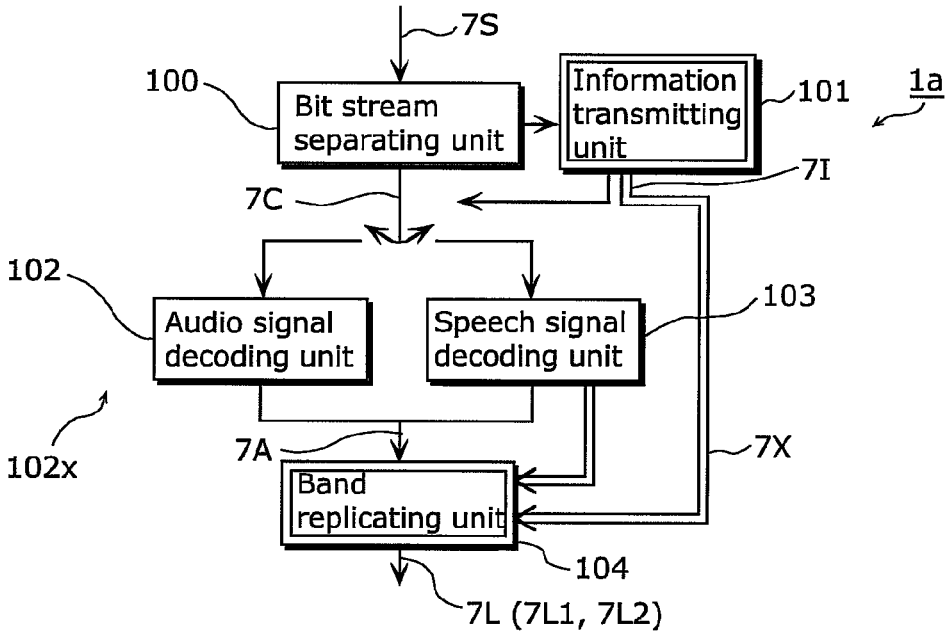
[FIG. 1]
Figure 5:
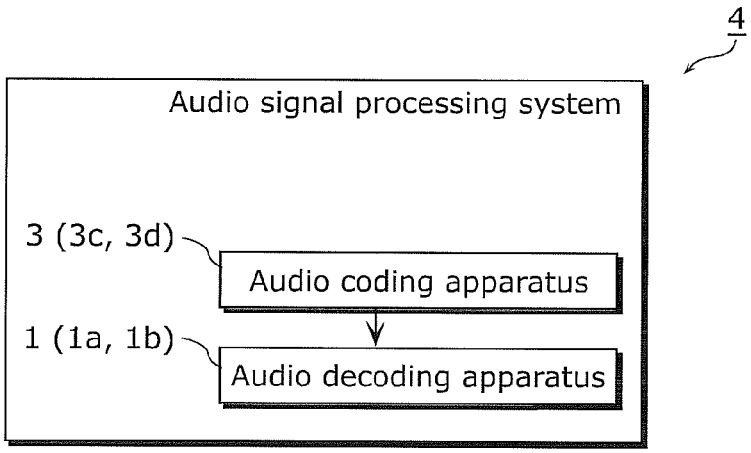
[FIG. 5]
Figure 12:
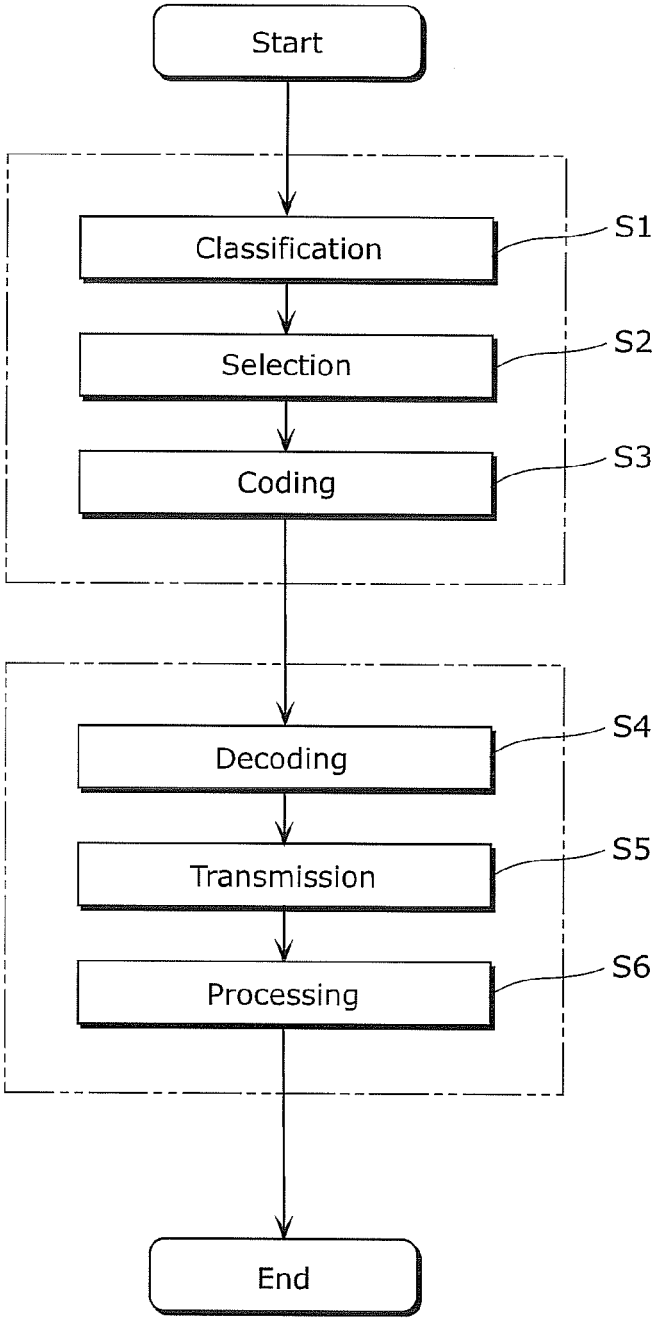
[FIG. 12]

Each of audio decoding apparatuses (an audio decoding apparatus 1 and an audio decoding apparatus 1*a* in FIG. 1, FIG. 5, Steps 4 to 6 in FIG. 12) according to embodiments of the present invention is an audio decoding apparatus which decodes a coded signal (such as a coded signal 7T) which has a property (for example, the amount of a speech component 7M) and is coded using one of coding schemes selected by an audio coding apparatus 3 as being suitably used to code the input signal (a signal to be coded 7P), according to the property of the input signal. Each of the decoding apparatuses comprises: a plurality of decoding units (an audio decoding unit 102 and a speech signal decoding unit 103) each of which (i) performs a corresponding one of coding schemes selectable in coding and (ii) decodes the coded signal in the case where the decoding unit is a corresponding decoding unit (a decoding unit for use) which performs the decoding scheme paired with the coding scheme used to code the signal to be coded; a signal processing unit (a band replacing unit 104, S6) which processes a decoded signal (a decoded signal 7A) generated from the coded signal by the corresponding decoding unit identified by information (such as containment information and type signal, information 7I) transmitted to the signal processing unit according to one of schemes which is suitable for the decoded signal; an information transmitting unit (an information transmitting unit 101, S5) which transmits, to the signal processing unit, information (information 7I) identifying the decoding unit for use from among the decoding units.

Here, an appropriate coding scheme is, for example, a coding scheme which achieves a comparatively small amount of data and a comparatively high sound quality when used to code a coded signal, as described in detail later.

In addition, a scheme suitable for a decoded signal decoded by the decoding unit is, for example, a scheme which processes the decoded signal to generate a processed signal closer to a predetermined signal and having a high accuracy, as described in detail later.

Here, a process in a certain scheme may be a process for enhancing a voice bandwidth, and a process in another scheme may be a process for outputting a raw input data or a process for simply waiting (doing nothing).

On the other hand, an audio coding apparatus (S1 to S3 in FIG. 5, FIG. 3, and FIG. 12 in this embodiment) is an audio coding apparatus (such as an audio coding apparatus 3C and an audio coding apparatus 3) comprising: a plurality of coding units (such as a plurality of coding units 300*x*, S3); a signal classifying unit which determines a classification (classification information S) of a property (for example, the amount of a speech component 7M) of an input signal as a classification of the input signal, according to the property; and a selecting unit (selecting unit 303, S2) which selects a coding unit for use (a selected coding unit) corresponding to the classification determined by the signal classifying unit and an index (index B) specified for the selecting unit from among the plurality of coding units, according to the classification and the index, and causes the selected coding unit for use to code the input signal.

In other words, it is also good to configure an audio signal processing system (audio signal processing system 4: FIGS. 5, S1 to S6 in FIG. 12) comprising the audio decoding apparatus and the audio coding apparatus.

In other words, in the audio coding apparatus 3 (FIG. 5, FIG. 3), the signal classifying unit 302 (FIG. 3) may determine whether a signal to be coded 7P is suitable for a speech codec or an audio codec (whether or not the amount of a speech component is large (larger than a threshold value) (see Step S1 in FIG. 12).

Figure 11:
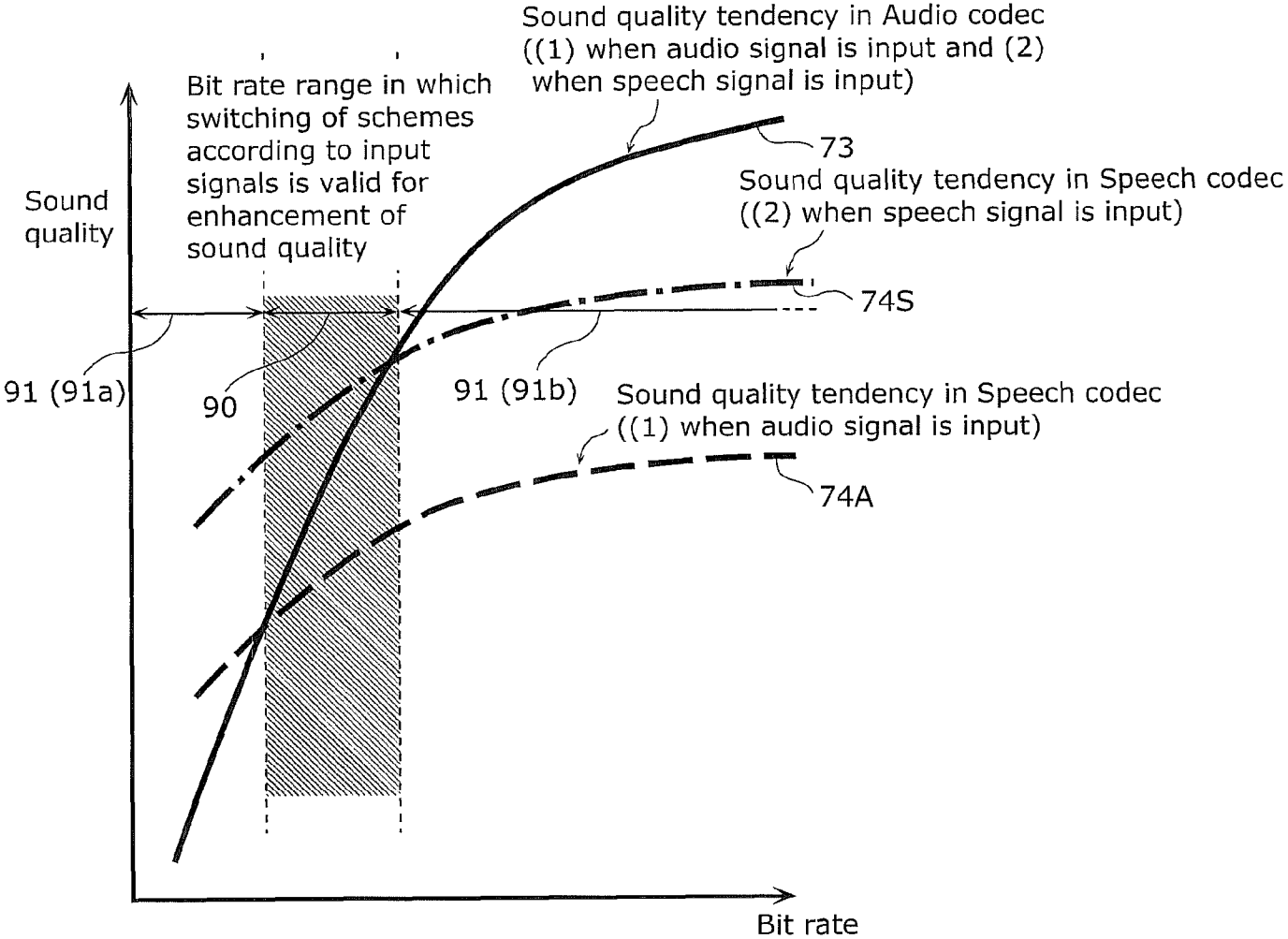
[FIG. 11]

When it is determined that a signal to be coded 7P is suitable for a speech codec ((2) in FIG. 11), one of the coding processing units (the plurality of coding units 300$x$) may code the signal to be coded 7P according to the speech codec.

When it is determined that a signal to be coded 7P is suitable for an audio codec ((1) in FIG. 11), one of the coding processing units may code the signal to be coded 7P according to the speech codec obtained (by the selecting unit 303) in the case where an index B (FIG. 3) shows a bit rate in the high range 91$a$ in which sound quality is good (FIG. 11) (see S2 and S3).

Alternatively, it is good to perform coding according to the audio codec only when this index shows bit rates within one of the other ranges (for example, the range 90) (see S2 and S3).

In the audio coding apparatus 1 (FIG. 5, FIG. 1), an input signal 7S (a coded signal 7C) to the audio decoding apparatus may be a coded signal 7T (FIG. 3) coded by the audio coding apparatus.

One of decoding units (a plurality of decoding units 102$x$) may perform decoding according to a speech codec in the case where the speech codec is specified by information 7I indicating whether the codec used in the coding of an input signal is a speech codec or an audio codec.

When an audio codec is specified, decoding in the audio codec may be performed (see S4).

Here, the aforementioned information 7I is, for example, information which is generated by a bit stream separating unit 100 or the like.

The band replicating unit 104 may perform a replication process on a band of a decoded signal.

Prior to this process, it is also good that the aforementioned information 7I is transmitted (a transmission line (transmission part) 7X in FIG. 1), and that the transmitted information 7I is obtained by the band replicating unit 104 (see S5).

Here, a first scheme may be used for the process in the case where the obtained information 7I indicates an audio codec, and a second scheme may be used for the process in the case where the obtained information 7I indicates a speech codec (see S6).

The second scheme is a scheme for generating, by using a linear prediction coefficient etc. a second replicated signal 7L2 which is more appropriate than a first replicated signal 7L1 (FIG. 1) generated according to a first scheme (see Patent Literature 1: Japanese Patent Publication No. 3189614).

In this way, it is possible to generate the more appropriate second processed signal 7L2. Furthermore, since such information 7I for identifying one of the decoding schemes is simply used and thus no additional information is necessary, it is possible to configure the audio decoding apparatus to have a simple structure.

When it is shown that an audio codec is suitable for the signal to be coded 7P, an audio coding apparatus 3 executes processing indicated below.

More specifically, if the specified index B indicates a bit rate within the range 91$a$ (see data 74A and 73 in the range 91$a$) in which sound quality is high in the case where a signal to be coded is coded using a speech codec even when it is shown that an audio codec is suitable for the signal to be coded, the signal to be coded is coded using the speech codec. Then, an audio decoding apparatus generates the more appropriate second processed signal 7L2.

In this way, in more cases, it is possible to generate the more appropriate second processed signal in a more reliable manner.

When it is shown that the audio codec is suitable but the bit rate is not within the range 91$a$ (see data 74A and 73 in the range 91$a$) in which the sound quality is high (see data 74A and 73 in the range 90 or the like), coding is performed according to the audio codec and a high sound quality is maintained.

In this way, it is possible to generate an appropriate second processed signal 7L2 in a more reliable manner, and maintain a high sound quality.

In this way, it is also possible to configure the audio coding apparatus 3 which is suitably combined with the audio decoding apparatus 1. In other words, it is also good to configure an audio signal processing system 4 comprising the audio coding apparatus 3 together with the audio decoding apparatus 1 (see FIG. 5 and FIG. 12).

Hereinafter, this is described in detail.

(Embodiment 1)

First, an audio decoding apparatus according to Embodiment 1 of the present invention is described with reference to the drawings.

FIG. 1 is a diagram showing a structure of the audio decoding apparatus 1$a$ according to Embodiment 1.

As shown in FIG. 1, the audio decoding apparatus 1$a$ comprises a bit stream separating unit 100, an information transmitting unit 101, an audio signal decoding unit 102, a speech signal decoding unit 103, and a band replicating unit 104.

The bit stream separating unit 100 separates a coded signal (input signal 7S) included in a bit stream (input signal 7S) from the bit stream input to the audio decoding apparatus 1$a$.

The information transmitting unit 101 extracts a type signal (containment information, voice presence or absence information) from information from the bit stream separating unit 100. The type signal is a signal indicating whether the coded signal separated by the bit stream separating unit 100 is a signal coded using an audio codec or a signal coded using a speech codec. The information transmitting unit 101 extracts this type signal, and transmits the extracted type signal (information 7I) to an other module (the band replicating unit 104 to be described later).

The audio signal decoding unit 102 decodes the coded signal in the case where the coded signal separated by the bit stream separating unit 100 is a signal coded using the audio codec. Here, the audio signal decoding unit 102 decodes the coded signal when the type signal indicates that the coded signal is a signal according to an audio codec.

The speech signal decoding unit 103 decodes the coded signal in the case where the coded signal separated by the bit stream separating unit 100 is a signal coded using the speech codec. Here, the speech signal decoding unit 103 decodes the coded signal when the type signal indicates that the coded signal is a signal according to a speech codec.

The band replicating unit 104 replicates the reproduction band of a signal (decoded signal 7A) decoded by one of the decoding units.

Figure 3:
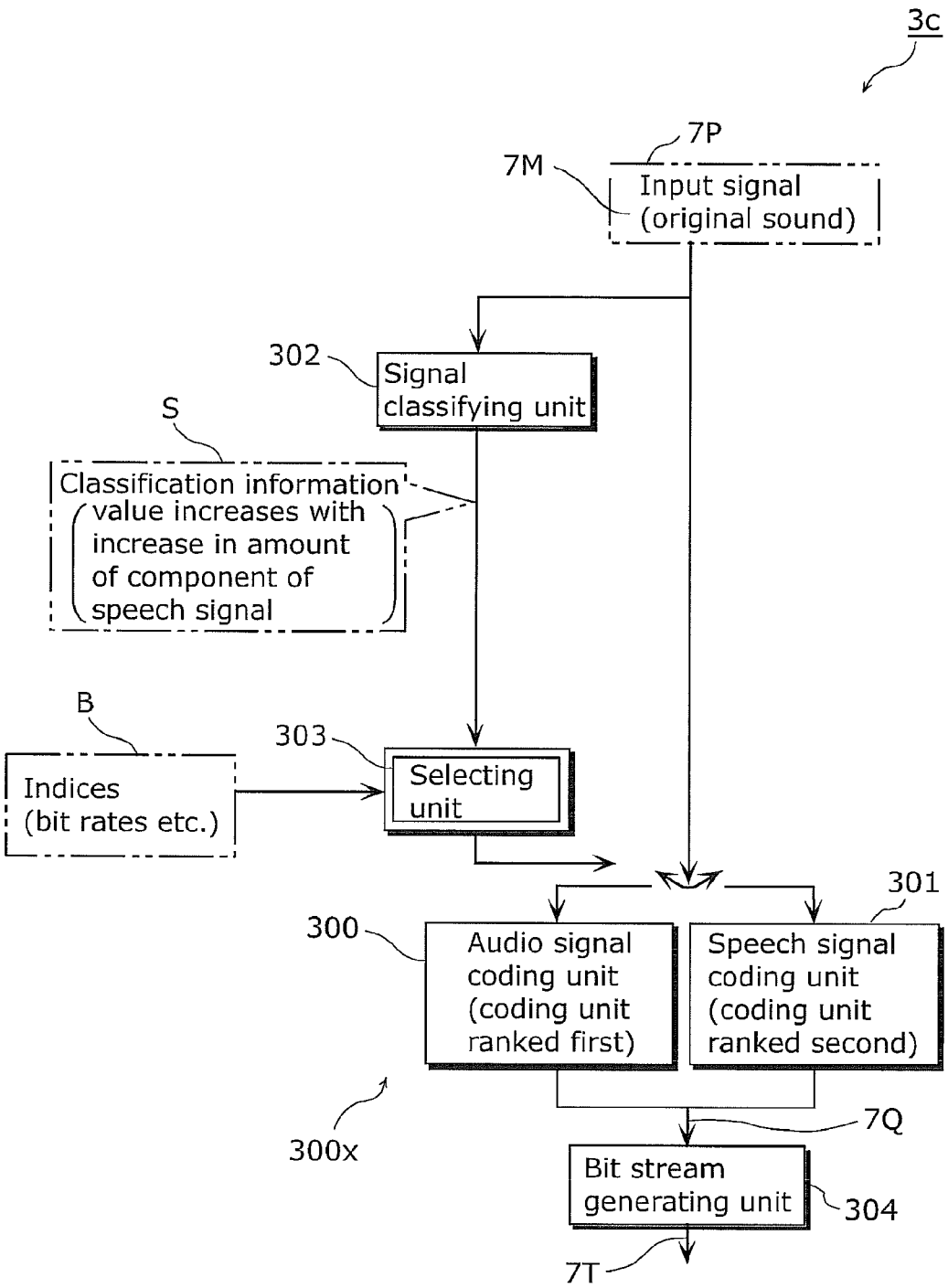
[FIG. 3]

In Embodiment 1, input bit streams are bit streams generated by selectively using coding units according to properties of the input signals (the coding units are, for example, the audio signal coding unit 300 and the speech signal coding unit 301 in FIG. 3). In other words, in the case where a signal to be coded included in the input bit stream is an audio signal, the coded signal is a signal generated by coding a raw frequency spectrum of the input signal according to a scheme such as the AAC scheme. In the case where a signal to be coded is a speech signal, the coded signal is a signal generated by separating the input signal into a linear prediction coefficient and an excitation signal (a signal which is an input to a linear prediction filter using the linear prediction coefficient) and coding each of the linear prediction coefficient and the excitation signal according to a scheme such as the AMR scheme.

Operations performed by the audio decoding apparatus configured in this way are described below.

First, the bit stream separating unit 100 separates the coded signal from the input bit stream.

Next, the information transmitting unit 101 extracts the type signal from information separated from the bit stream separating unit 100. The type signal is a signal indicating whether the coded signal separated by the bit stream separating unit 100 is a signal coded using an audio codec or a signal coded using a speech codec. The information transmitting unit 101 transmits the extracted type signal to the band replicating unit 104.

Next, the audio signal decoding unit 102 decodes the coded signal in the case where the coded signal separated by the bit stream separating unit 100 is a signal coded using the audio codec.

In this embodiment, for example, the audio codec is the AAC scheme, and thus the audio signal decoding unit 102 is a decoding unit conforming to the AAC Standard. However, the present invention is not limited thereto. For example, decoding units for decoding a frequency spectrum signal conforming to the MP3 scheme, the AC3 scheme, or the like are also possible.

On the other hand, the speech signal decoding unit 103 decodes the coded signal in the case where the coded signal separated by the bit stream separating unit 100 is a signal coded using the speech codec.

In this embodiment, for example, the speech codec is the AMR scheme, and thus the speech signal decoding unit 103 is a decoding unit conforming to the AMR Standard. However, the present invention is not limited thereto. In other words, any other decoding units are possible as long as the decoding units are intended to separate an input signal into a linear prediction coefficient and an excitation signal and decode each of the linear prediction coefficient and the excitation signal according to a scheme such as the G.729 scheme.

Lastly, the band replicating unit 104 replicates the reproduction band of a signal (decoded signal) decoded by one of the decoding units which is a decoding unit for use. Here, the decoding unit for use is the audio signal decoding unit 102 when the coded signal to be decoded is a signal coded using an audio codec, and the decoding unit for use is the speech signal decoding unit 103 when the coded signal to be decoded is a signal coded using a speech codec. Here, it is important for the band replicating unit 104 to switch schemes for replicating the reproduction band according to information (information 7I) from the information transmitting unit 101. Hereinafter, this point is described.

In the case where the input coded signal is a signal in the audio codec, the band replicating unit 104 may perform, as the scheme for replicating the reproduction band, a scheme for copying, in a high-frequency band, a frequency spectrum signal of a low-frequency signal and shaping the waveform of the high-frequency signal based on predetermined bit stream information according to a scheme such as the SBR scheme (see the SBR technique: ISO/IEC11496-3).

In the opposite case where the input coded signal is a signal coded using the speech codec, the band replicating unit 104 may perform, as the scheme for replicating the reproduction band, a scheme which is a modified version of the SBR scheme. This modified version is described in detail below. First, the band replicating unit 104 generates a high frequency component according to a scheme similar to the SBR scheme. After the generation of the high frequency component, the band replicating unit 104 calculates the frequency envelop characteristic of the high-frequency band based on the linear prediction coefficient included in the coded signal. Subsequently, the band replicating unit 104 modifies the frequency characteristic of the high-frequency band according to the calculated frequency envelop characteristic. In this way, the frequency characteristic of the high-frequency band is modified (the waveform is shaped) with a high accuracy to have a characteristic closer to an original sound.

Here, as for the scheme for calculating the frequency envelop characteristic of the high-frequency band based on the linear prediction coefficient, for example, a conventionally known scheme may be used. As a specific example, the scheme described in Patent Literature 1: Japanese Patent Publication No. 3189614 is possible.

As described above, according to this embodiment, an audio decoding apparatus (audio decoding apparatus 1*a*) is configured to comprise: a bit stream separating unit (bit stream separating unit 100) which separates a coded signal from an input bit stream; an information transmitting unit (information transmitting unit 101) which extracts information (type information) indicating whether the coded signal is a coded signal coded using an audio codec or using a speech codec from among information from the bit stream separating unit, and transmits the extracted signal to an other module; an audio signal decoding unit (audio signal decoding unit 102) which decodes the coded signal separated by the bit stream separating unit in the case where the coded signal is the signal coded using the audio codec; a speech signal decoding unit (speech signal decoding unit 103) which decodes the coded signal separated by the bit stream separating unit in the case where the coded signal is the signal coded using the speech codec; and a band replicating unit (band replicating unit 104) which replicates a reproduction band of a signal (decoded signal) decoded by one of decoding units (which is a decoding unit for use), wherein the band replicating unit selectively performs suitable schemes for replicating the reproduction band according to information (type information) transmitted from the information transmitting unit so as to highly accurately modify the frequency characteristic of the high-frequency band to have a frequency characteristic closer to an original sound and to thereby achieve a good sound quality.

Figure 2:
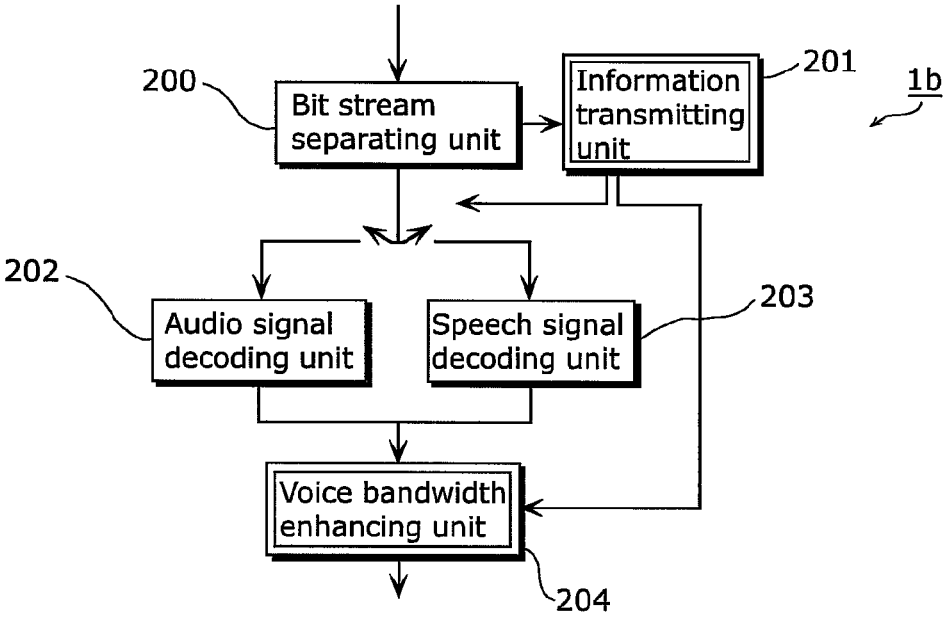
[FIG. 2]

FIG. 2 shows a diagram of an audio decoding apparatus 1*b* (comprising a bit stream separating unit 200, an audio signal decoding unit 202, a speech signal decoding unit 203, a voice bandwidth enhancing unit 204, and an information transmitting unit 201).

In this embodiment, the process for replicating the frequency band has been described as a post-decoding process performed on a decoded signal by the signal processing unit (band replicating unit 104). However, it is to be noted that the post-decoding process (by the signal processing unit) is not limited thereto. For example, the post-decoding process may be a process for enhancing a voice bandwidth.

In recent audio reproduction environment, a signal to be reproduced (decoded signal) includes a deep bass sound signal or a high-frequency signal, and frequency characteristics of a speaker have been enhanced (the speaker is capable of reproducing sounds from the deep bass sound signal to the high-frequency signal). For this reason, as a result, listeners can now enjoy rich acoustic signals. In contrast, in the case of a video content or the like, there is a problem that voices (human voices: serif) are mixed into rich acoustic signals and difficult to be heard. In this case, enhancement of a voice signal bandwidth (suppression of the deep bass sound signal and the high-frequency signal) makes it easier to hear the voices, making it difficult to enjoy the rich acoustic signals.

In such a case, the audio decoding apparatus 1*b* having the aforementioned structure performs a process described below in the case where a signal (type signal) from the information transmitting unit 201 shows a state where a speech signal is currently being reproduced, that is, the type signal shows that the coded signal is coded using a speech codec. The process performed here by a signal processing unit (voice bandwidth enhancing unit 204) is a process for enhancing a voice signal bandwidth. By performing this process, the following problem is solved. Specifically, it is possible to enhance the voice signal only when content includes a voice signal (for example, only in the case where the content includes voices corresponding to serif), and it is possible to enjoy rich acoustic signals in the opposite case. FIG. 2 shows a structure of the audio decoding apparatus in such a case. FIG. 2 is different from FIG. 1 in that a voice bandwidth enhancing unit 204 replaces the band replicating unit 104.

In this embodiment, the post-decoding process of the decoded signal may be a process by an echo cancelling unit.

Figure 7:
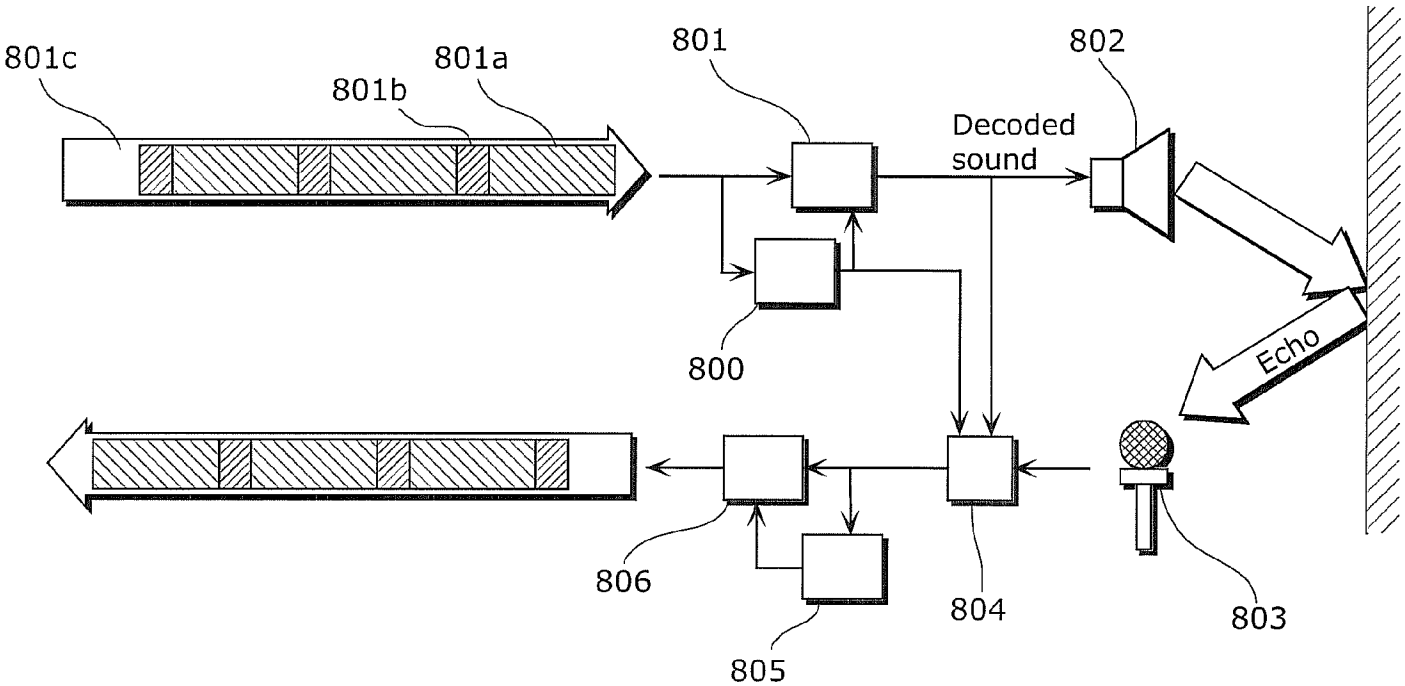
[FIG. 7]

FIG. 7 is a diagram showing a configuration of a communication system (audio signal processing system) in the case where the post-decoding process performed on the decoded signal is echo canceling by the echo cancelling unit.

In FIG. 7, the input bit stream is made of a coded voice signal (signal 801*a*) and voice presence or absence information (information 801*b*) indicating whether or not the coded voice signal includes a voice signal. Here, as shown in the earlier example, the voice presence or absence information may be information indicating whether the bit stream (a bit stream 801*c*, a coded signal) of the frame is a stream coded using an audio codec or a stream coded using a speech codec. In addition, the voice presence or absence information may be information indicating a containment rate of a speech signal in the frame. Alternatively, the voice presence or absence information may be information indicating the strength of a pitch component of the voice.

FIG. 7 shows a communication system comprising a voice presence or absence information separating unit 800, a decoding unit 801, a speaker 802, a microphone 803, an echo canceller 804, a voice presence or absence determining unit 805, and a coding unit 806, The voice presence or absence information separating unit 800 extracts voice presence or absence information from an input bit stream.

The decoding unit 801 decodes the input bit stream.

Here, the decoding unit 801 may be a decoding unit which supports a scheme for decoding the input bit stream using the voice presence or absence information, or a decoding unit which supports a scheme for decoding the input bit stream without using the voice presence or absence information.

The speaker 802 converts an output signal from the decoding unit to an audible signal.

The microphone 803 receives a sound in an acoustic space in which the speaker 802 is a sound source.

An echo cancelling unit 804 receives, as inputs, a decoded signal decoded by the decoding unit 801, a signal received through the microphone 803, and the voice presence or absence information, and removes an echo component of the decoded signal from the signal received through the microphone 803.

The voice presence or absence determining unit 805 determines whether the output signal from the echo cancelling unit 804 includes a speech signal.

The coding unit 806 codes the output signal from the echo cancelling unit 804.

The communication system including the echo cancelling unit 804 is configured as described above, providing an advantageous effect described below.

The echo cancelling unit 804 in a signal processing apparatus generates a simulated echo signal by identifying a transfer function in space in which an echo is generated. The echo cancelling unit 804 removes an echo by subtracting the generated simulated echo signal from the received signal (a signal including an echo) (for example, see Non-patent Literature: "Subband Echo Canceller with an Exponentially Weighted Stepsize NLMS Adaptive Filter", the Journal of the Institute of Electronics, Information and Communication Engineers, A Vol, J79-A No. 6, pp. 1138-1146, June, 1996

Here, it is possible to identify the transfer function in the space in the case where the sound source of the sound received through the microphone 803 is generated from only a sound from the speaker 802. In other words, it is difficult to identify the transfer function in the space in the case where the sound received through the microphone 803 includes any sound other than the sound from the speaker 802 (in the case of a double talk). In such a case, that is, in the case where the sound to be received includes the other sound, the signal processing apparatus is controlled such that the signal processing apparatus stops learning for the identification. The signal processing apparatus having the structure as shown in FIG. 7 transfers the voice presence or absence information separated by the voice presence or absence separating unit 800 to the echo cancelling unit 804. For this reason, the echo cancelling unit 804 is capable of easily determining the presence or absence of a voice signal in a decoded voice. In this way, it is possible to easily detect a double talk state.

Figure 8:
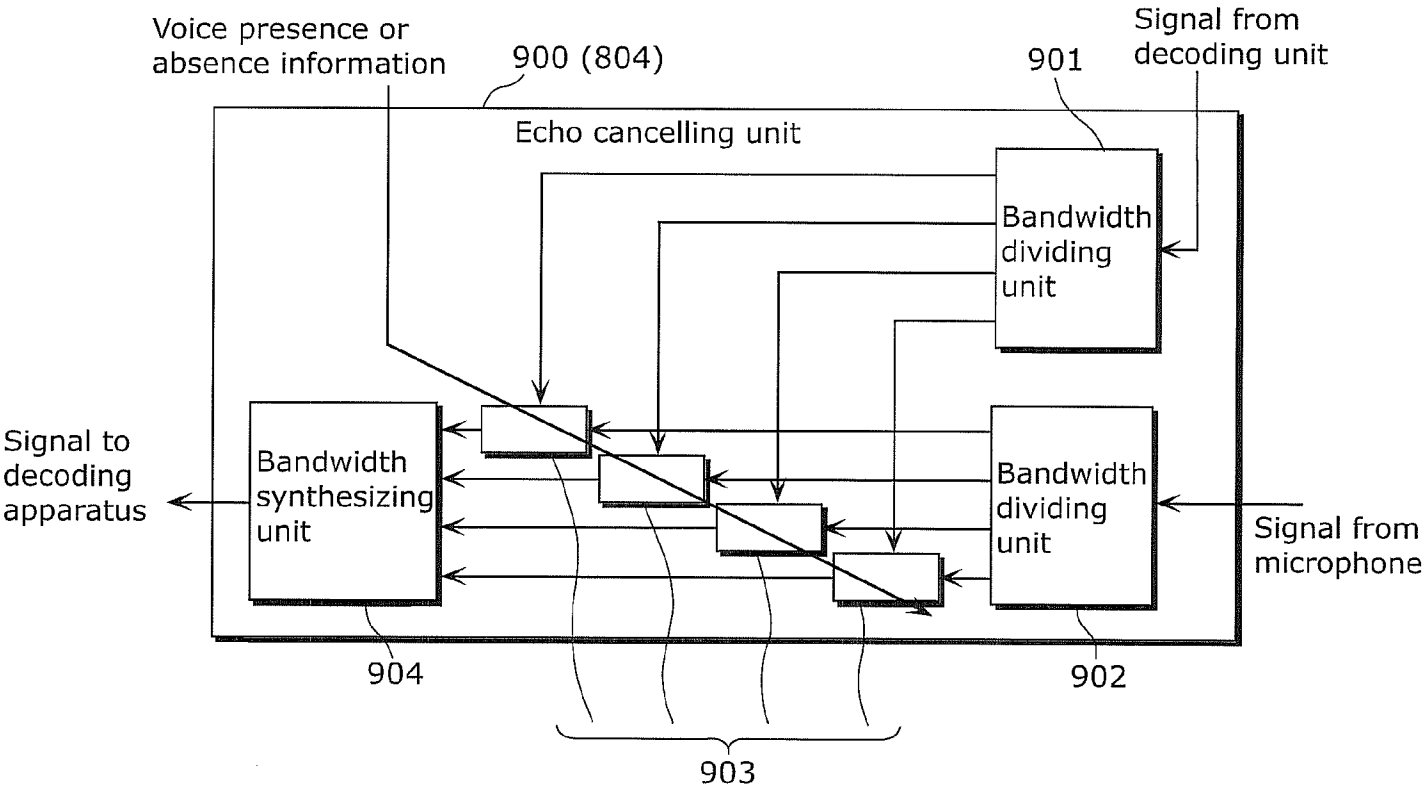
[FIG. 8]

FIG. 8 is a diagram showing an echo cancelling unit 900.

Here, as a specific example, the echo cancelling unit 804 may support a scheme for dividing an input signal into sub bands and identifying a transfer function in space for each of the sub bands, as performed by an echo cancelling unit 900 (comprising a bandwidth dividing unit 901, a bandwidth dividing unit 902, band-based processing units 903, and a bandwidth synthesizing unit 904). In addition, it is also good to identify the transfer function in the space using filters having mutually different tap lengths for the respectively corresponding ones of the sub bands. Furthermore, in this case, it is also good to perform control so as to adjust tap lengths according to the case where a voice signal is determined to be included and the opposite case, and then identify the transfer functions in the voice bands. Here, it is also good that each of the band-based processing units 903 may identify the transfer function for the corresponding one of the bands. In addition, it is also good that each of the band-based processing units 903 may perform processing using an echo removal filter. Here, a frequency in a low frequency signal may be subjected to echo removal using a filter having a Tap length longer than the Tap length in a high frequency signal higher than a low frequency signal. In addition, when it is determined that a voice signal is included based on the voice presence or absence information (otherwise, when it is determined that the containment rate of the voice information is great (greater than a threshold value), it is also good that echo removal is performed on the signal of the voice band using a filter having a comparatively long Tap length.

Subsequently, a next description is given below. As a specific example, the details of the audio decoding apparatus 1*a* (audio decoding apparatus 1) are described below. It is to be noted that the following description is a mere example.

FIG. 5 is a diagram showing an audio signal processing system 4.

The audio signal processing system 4 includes an audio coding apparatus 3 and an audio decoding apparatus 1.

The audio decoding apparatus 1 is the audio decoding apparatus 1*a*. Here, the audio decoding apparatus 1 may be an audio decoding apparatus 1*b* or another decoding unit.

Here, each of the audio decoding apparatus 1*a* and the audio decoding apparatus 1*b* may be a structural element of the audio signal processing system 4 or an independent structure.

The bit stream separating unit 100 (FIG. 1) generates a coded signal included in a bit stream input to the audio decoding apparatus 1 from the bit stream. The coded signal is a coded signal generated by coding a coding-target signal (a signal to be coded (input signal) input to the audio coding apparatus 3) by the audio coding apparatus 3.

The coded signal is a coded signal of one of a plurality of (N number of) coded signals. Each of the coded signals of the kinds is a coded signal that a corresponding one of the plurality of (N number of) coding units (for example, the plurality of coding units 300*x* in FIG. 3 described below) decodes according to the corresponding coding scheme.

Each of the coded signals of the kinds includes a speech component in an amount corresponding to the kind. Each of the coded signals of the kind is generated by coding a signal to be coded containing a speech component in a certain amount corresponding to the kind according to the coding scheme most suitable for the signal to be coded.

The coded signals of the kinds includes a specific coded signal which is a coded signal (indicating a linear prediction coefficient and the like) generated by coding the linear prediction coefficient and an excitation signal of a signal to be coded. The linear prediction coefficient and the excitation signal are data based on which the signal to be coded is obtained according to a predetermined formula corresponding to the model of an acoustic characteristic of a human vocal tract.

The plurality of decoding units 102*x* (FIG. 1) includes a plurality of (N number of) decoding units (an audio signal decoding unit 102, for example) which decodes the coded signals of the kinds. The plurality of decoding units 102*x* (FIG. 1) decodes the coded signals obtained by the bit stream separating unit 100. In other words, each of the coded signals is decoded by a corresponding one of the decoding units which corresponds to the coded signal.

In other words, this audio decoding apparatus 1 is an audio decoding apparatus conforming to the USAC Standard which is the latest standard that is currently being standardized.

The audio decoding apparatus 1 includes a band replicating unit 104.

The band replicating unit 104 modifies a high frequency portion of the decoded signal decoded by the decoding unit for use (mentioned earlier) such that the high frequency portion is closer to a high frequency portion of the signal to be coded (original sound) of the decoded signal. The band replicating unit 104 replicates the reproduction band of the decoded signal in this way.

More specifically, the band replicating unit 104 identifies one of a first scheme and a second scheme when replicating such a reproduction band, and replicates the reproduction band according to the identified scheme.

According to the first scheme, the band replicating unit 104 replicates the band by performing a modification of copying a frequency spectrum corresponding to a frequency spectrum of a low frequency signal in a decoded signal to a high frequency band of the decoded signal.

According to the second scheme, the band replicating unit 104 calculates an envelope characteristic of the decoded signal from the linear prediction coefficient and the excitation signal in the coded signal decoded by the speech signal decoding unit 103 or the like, according to a scheme such as a scheme described in Japanese Patent Application Publication No. 3189614. The band replicating unit 104 replicates the band by modifying the high frequency portion of the decoded signal according to modification details identified by the envelope characteristic, with a high accuracy higher than the accuracy in the modification using the first scheme. Here, a higher accuracy means that, for example, a signal resulting from the replication is more closer to a signal to be coded.

As a specific example, it is also good to modify, using the second scheme, a decoded signal into a processed decoded signal (signal 7L (signal 7L2)) having an envelope characteristic closer, with respect to the coded signal to be decoded, to the calculated envelope characteristic than the envelope characteristic of the signal (signal 7L (signal 7L1)) processed according to the first scheme.

The information transmitting unit 101 obtains containment information indicating whether the coded signal to be decoded is a specific coded signal generated by coding a linear prediction coefficient and an excitation signal, from, for example, the bit stream separating unit 100 (a selection information obtaining unit). For example, the containment information is a part of or the whole type signal (information 7I) indicating the type of the coded signal. The information transmitting unit 101 transmits the obtained containment information to the band replicating unit 104. In the case where the coded signal is not a specific coded signal, the information transmitting unit 101 obtains first containment information indicating the fact and transmits the obtained first containment information to the band replicating unit 104, and thereby causes the band replicating unit 104 to replicate the band according to the first scheme. In the opposite case where the coded signal is a specific coded signal, the information transmitting unit 101 obtains second containment information indicating the fact and transmits the obtained second containment information to the band replicating unit 104, and thereby causes the band replicating unit 104 to replicate the band according to the second scheme.

Descriptions related to the audio decoding apparatuses (audio decoding apparatus 1, audio decoding apparatus 1*a*) are given below. The plurality of coding schemes includes the first scheme suitable for a case where the amount of a speech component included in the input signal is a first amount (a case of (1) in FIG. 11) and a second scheme suitable for a case where the amount of a speech component included in the input signal is a second amount larger than the first amount (a case of (2) in FIG. 11). The coded signal coded using the second scheme is a signal in which a linear prediction coefficient and an excitation signal are coded. The linear prediction coefficient and the excitation signal are data based on which the input signal is calculated by the audio decoding apparatus 1 or the like according to a formula corresponding to an acoustic characteristic model of a human vocal tract. The audio decoding apparatus is an audio decoding apparatus conforming to the Unified Speech and Audio Codec (USAC). The linear prediction coefficient identifies the envelope characteristic of the input signal The signal processing unit (i) modifies the decoded signal into the first processed signal closer to the input signal when one of the decoding units (audio signal decoding unit 102) which corresponds to a scheme other than the second scheme (a scheme of the specific coded signal) is identified by the information transmitted to the signal processing unit, and (ii) modifies the decoded signal into the second processed signal closer to the input signal than the first processed signal when one of the decoding units (speech signal decoding unit 103) which corresponds to the second scheme is identified by the information transmitted to the signal processing unit. Here, the second processed signal has an envelope characteristic closer to the envelop characteristic identified by the linear prediction coefficient than the envelope characteristic of the first processed signal.

In this way, it is possible to reliably perform a process according to a more appropriate scheme based on the envelope characteristic.

Here, the signal processing unit (voice bandwidth enhancing unit 204) modifies the decoded signal into a processed signal different from the decoded signal in the process according to the second scheme. On the other hand, the processed signal in the process according to the first scheme may be the same as the decoded signal (a signal for which no voice enhancement is performed).

(Embodiment 2)

Hereinafter, an audio coding apparatus according to Embodiment 2 of the present invention is described with reference to the drawings.

Figure 9:
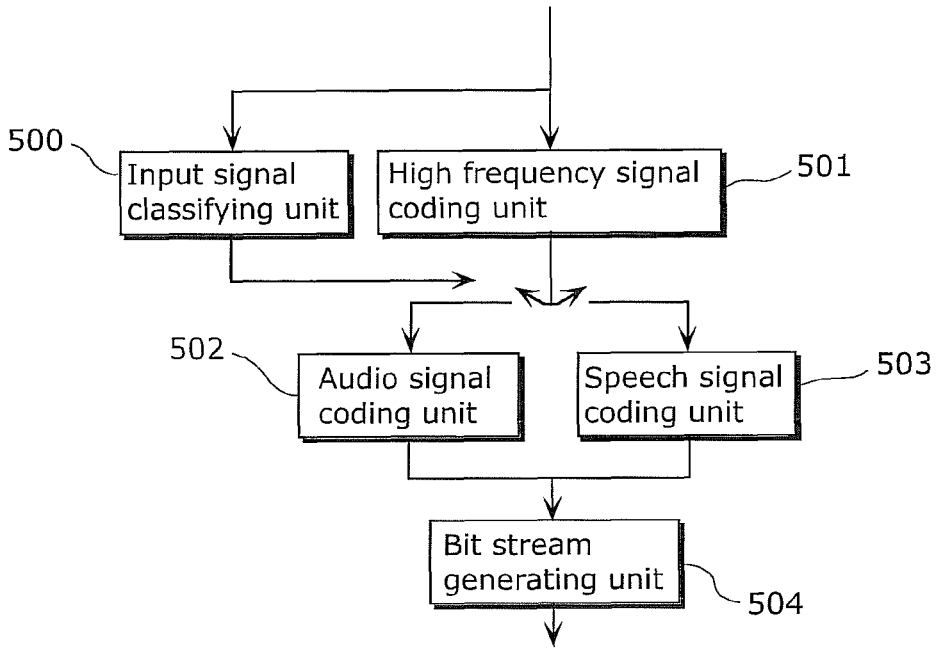
[FIG. 9]
Figure 10:
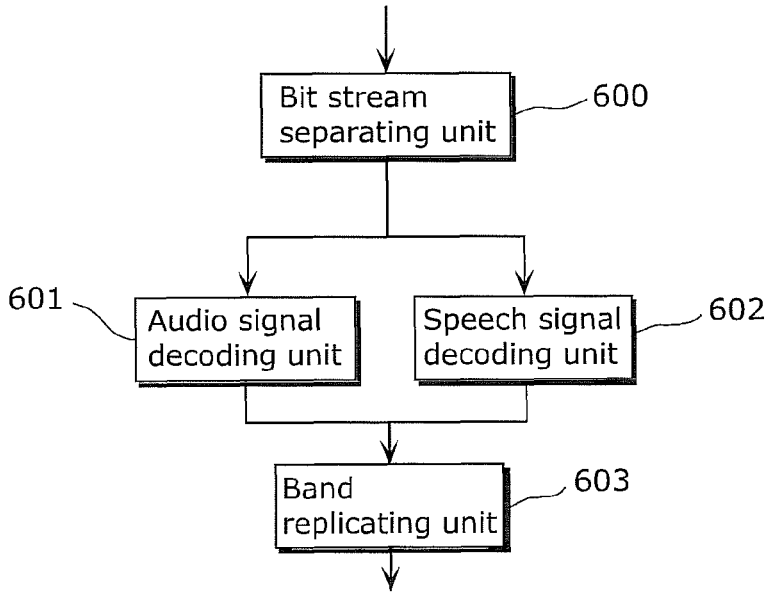
[FIG. 10]

In the case of the audio coding apparatus having a structure as shown in FIG. 9 described in the Background Art section, which one of the coding units should be used is determined based on classifications by an input signal classifying unit 500.

However, as shown in a range 91 in FIG. 11, when the coding bit rate of an input signal is larger than a predetermined value (a range 91*b*) even if the input signal is classified as a speech signal, the input signal can have a high sound quality when the input signal is coded using an audio signal coding unit than when coded using a speech signal coding unit. In addition, when the bit rate of a signal to be coded (an input signal) is a small bit rate in a range 91*a* even if the input signal is classified as an audio signal, the input signal can have a high sound quality when the input signal is coded by the speech signal coding unit. If which one of the coding schemes should be used is determined based only on the output (the result of the classification) from the input signal classifying unit 500 regardless of the bit rate by ignoring the fact that the speech signal coding unit is suitable in this case, there arises a problem that the optimum coding scheme is not selected.

FIG. 11 has been mentioned in the description in the earlier Background Art section. However, FIG. 11 has been mentioned only for the convenience of explanation. The content shown in FIG. 11 had not been focused on before the present invention was made, in other words, the content was focused on for the first time when the present invention was made. FIG. 11 shows a problem in the conventional art which was focused for the first time when the present invention was made.

The present invention was made in view of the problem in the conventional art as shown in FIG. 11, and provides an audio coding apparatus which is capable of coding an input signal according to a most appropriate coding scheme.

In other words, the present invention has an object of enabling processing a decoded signal according to an appropriate scheme (see the audio decoding apparatus 1*a* and the like). In addition, the present invention has another object of enabling reliable coding by the appropriate coding scheme. In addition, the present invention has another object of obtaining various kinds of advantageous effects derived from these advantageous effects.

FIG. 3 is a diagram showing a structure of an audio decoding apparatus 3*c* according to Embodiment 2.

As shown in FIG. 3, the audio coding apparatus 3*c* includes an audio signal coding unit 300, a speech signal coding unit 301, a signal classifying unit 302, a selecting unit 303, and a bit stream generating unit 304.

The audio signal coding unit 300 codes a frequency spectrum signal of an input signal (a signal to be coded 7P)

The speech signal coding unit 301 divides the input signal into a linear prediction coefficient and an excitation signal, and codes each of the divided linear prediction coefficient and the excitation signal.

The signal classifying unit 302 classifies the input signal according to a property of the input signal. More specifically, the signal classifying unit 302 may determine, to be a classification of an input signal, a classification (classification information S) indicating the amount of a speech component (component 7M) included in the input signal.

The selecting unit 303 selects which one of the plurality of coding units 300*x* should be used by an audio coding apparatus 3*c*. In other words, the selecting unit 303 selects, as a selected coding unit, the one of the plurality of coding units 300*x*, and causes the audio coding apparatus 3*c* to use the selected coding unit selected as the coding unit for use which should be used in the coding of the signal to be coded.

The bit stream generating unit 304 packs each of the coded signals (coded signals 7Q) coded by the coding unit for use to generate a bit stream (a coded signal 7T) in which the coded signals are packed. The bit stream generated here may be a bit stream of the earlier-mentioned bit stream of the input signal 7S (FIG. 1) (see FIG. 5).

In Embodiment 2, the audio signal coding unit 300 is assumed to be a coding unit ranked first. The coding scheme is, for example, the AAC scheme. However, the coding scheme is not limited thereto. Any other schemes for coding a frequency spectrum signal of an input signal are also possible. In Embodiment 2, the speech signal coding unit 301 is assumed to be a coding unit ranked second. The coding scheme is, for example, the AMR scheme. However, the coding scheme is not limited thereto. Any other schemes are also possible as long as the schemes are for dividing an input signal into a linear prediction coefficient and an excitement signal and coding each of the linear prediction coefficient and the excitement signal.

Next, operations performed by the audio decoding apparatus 3*c* configured in this way are described below.

The signal classifying unit 302 classifies the input signal according to a property of the input signal. More specifically, the signal classifying unit 302 classifies the input signal as one of a speech signal and a non-speech signal. Here, it is also good that the signal classifying unit 302 determines how much a speech signal component is contained in the case where the input signal is a speech signal including a background sound, and classifies the input signal into one of the speech signal and the non-speech signal, based on whether the determined containment degree (amount) is equal to or greater than the threshold value or not.

For example, in the case where the input signal includes only a speech signal, the signal classifying unit 302 determines a variable S (classification information S) as 10. In the opposite case where the input signal does not includes any speech signal, the signal classifying unit 302 determines a variable S (classification information S) as 0.In addition, the signal classifying unit 302 selectively sets values ranging from 0 to 10 according to the containment degree of a speech signal in the case where the input signal is a mixed signal including the speech signal.

Next, the selecting unit 303 selects one (a coding unit for use) of the plurality of coding units, based on a variable S which is set by the signal classifying unit 302 and an index B which is separately input.

In the case where the variable S is comparatively small (in the case where the containment degree of a speech signal in the input signal is small), the selecting unit 303 selects a coding unit ranked high (the coding unit ranked first in this embodiment, that is, the audio signal coding unit 300). The selecting unit 303 selects one of the coding units which is ranked high (for example, the coding unit ranked second, that is, the speech signal coding unit 301 in this embodiment) in the case where the variable S is large (in the case where the containment degree of a speech signal in the input signal is large).

However, the selecting unit 303 selectively selects the coding units such that the coding unit ranked high is used more frequently when the coding bit rate indicated by an index B is a high bit rate. For example, in the case where the index B indicates a bit rate larger than a predetermined bit rate, the selecting unit 303 uses a coding unit more frequently (at a more higher rate) than a coding unit ranked lower than a predetermined rank which is used when the index B indicates a bit rate equal to or lower than the bit rate in this case.

More specifically, for example, a selection process is as described below.

For example, in the case where the index B shows 24 kbps, the selecting unit 303 selectively selects the audio signal coding unit 300 when S is equal to or smaller than 5, and selects the speech signal coding unit 301 when a variable S is greater than 5. On the other hand, for example, in the case where the index B shows 32 kbps, the selecting unit 303 selectively selects the audio signal coding unit 300 when a variable S is equal to or smaller than 7, and selects the speech signal coding unit 301 when S is greater than 7. As another example, in the case where the index B shows 48 kbps, the selecting unit 303 always selects the speech signal coding unit 301 irrespective of the value of S. This is because the tendencies of sound qualities provided by the respective coding units are as shown in FIG. 11.

In the graph of FIG. 11, the horizontal axis shows bit rates in coding, and the vertical axis shows sound quality. A solid curve shows the relationships between bit rates and sound quality in an audio codec such as AAC. The curve represented as an alternate long and short dash line shows the relationships between bit rates and sound quality in the case where speech signal processing is performed according to a speech codec such as AMR. In other words, a curve (data 74A) represented as a broken line in FIG. 11 shows the relationships between bit rates and sound quality in the case where a non-speech signal is processed according to a speech codec. As shown in FIG. 11, irrespective of whether an input signal is a speech signal (a case of (2)) or not (a case of (1), an audio codec (data 73) makes it possible to code the signal to have a higher sound quality in the case where a bit rate is larger than a predetermined value (for example, a value that is the lower limit of the range 91*b*).

In view of this feature, it is not suitable for selecting a coding unit based on whether the input signal is a speech signal or not (based only on classification information S). For this reason, the selecting unit 303 selects a suitable coding unit based on the classification information S and an index B which is input from outside separately.

In other words, for example, the signal classifying unit 302 may determine the classification of the signal to be coded from among classifications (a variable S is a value in a range from 0 to 10) the number of which is larger than the number of coding units included in the plurality of coding units 300*x* (FIG. 3). The selecting unit 303 identifies a threshold value (for example, 5) corresponding to an index B (for example, 24 kbps), as a threshold value for these classifications. In the case where the classification (S) identified by the signal classifying unit 302 is a small classification having a threshold value of 5 or smaller, the selecting unit 303 selects a coding unit ranked comparatively low (audio signal coding unit 300). In the opposite case where the classification (S) identified by the signal classifying unit 302 is a large classification having a threshold value larger than 5, the selecting unit 303 selects a coding unit ranked comparatively high (speech signal coding unit 301).

In the case where a bit rate (for example, 48 kbps) that is not a reference bit rate (for example, 32 kbps) is shown by the index B, the selecting unit 303 identifies a threshold value (infinity) different from the comparison threshold value of 7 for identification used in the case where the reference bit rate is shown. In other words, in the case where a bit rate (for example, 48 kbps) that is larger than the reference bit rate is shown by the index B, the selecting unit 303 selects the threshold value (for example, infinity) larger than the reference threshold, selects the coding unit ranked comparatively low (audio signal coding unit 300) more frequently, and selects the coding unit ranked comparatively high (speech signal coding unit 301) less frequently. In the opposite case where a bit rate (for example, 24 kbps) that is smaller than the reference bit rate (for example, 32 kbps) is shown by the index B, the selecting unit 303 selects a threshold value of 5 smaller than the reference threshold value of 7, selects the coding unit ranked comparatively low (audio signal coding unit 300) less frequently, and selects the coding unit ranked comparatively high (speech signal coding unit 301) more frequently.

The selecting unit 303 does not always need to identify such a threshold value. In other words, for example, processing as indicated below may be performed in a part of or the whole aspect. For example, in the case where a bit rate (for example, a bit rate in the range 91*b*) larger than a predetermined bit rate (for example, a bit rate in the range 90 in FIG. 11) is shown by an index B, it is also good that the selecting unit 303 selects the coding unit ranked comparatively low (the audio signal coding unit 300) instead of selecting the coding unit ranked comparatively high (the speech signal coding unit 301) irrespective of whether which one of the classifications is identified by the signal classifying unit 302. In the case where a bit rate (for example, a bit rate in the range 91*a*) smaller than a predetermined bit rate is shown by an index B, it is also good that the selecting unit 303 selects the coding unit ranked comparatively high (the speech signal coding unit 301) instead of selecting the coding unit ranked comparatively low (the audio signal coding unit 300) irrespective of the classification identified by the signal classifying unit 302.

Next, when the selecting unit 303 selects the audio signal coding unit 300, the audio signal coding unit 300 codes the input signal.

On the other hand, when the selecting unit 303 selects the speech signal coding unit 301, the speech signal coding unit 301 codes the input signal.

Lastly, the bit stream generating unit 304 packs at least one coded signal into a bit stream, to generate a bit stream.

As described above, the audio coding apparatus according to this embodiment comprises: an audio signal coding unit (audio signal coding unit 300) which codes a frequency spectrum signal of an input signal (a signal to be coded 7P); a speech signal coding unit (speech signal coding unit 301) which divides the input signal into a linear prediction coefficient and an excitation signal, and codes each of the linear prediction coefficient and the excitation signal; a signal classifying unit (signal classifying unit 302) which classifies the input signal according to a property of the input signal; a selecting unit (selecting unit 303) which selects which one of the coding units should be used as the selected coding unit (the coding unit for use); and a bit stream generating unit (bit stream generating unit 304) which packs the coded signal to generate a bit stream. In the audio coding apparatus configured as described above, the selecting unit is capable of selecting the optimum one of the coding units based on a result of classification (classification information S) by the signal classifying unit and the predetermined index B (bit rate). Thus, it is possible to select the optimum one of the coding units according to the classification of the input signal and the characteristics of the coding units, and to thereby achieve an excellent sound quality.

Here, the index B may be profile information described below.

The index input to the selecting unit 303 is a bit rate in coding in this embodiment. However, the index may be, for example, an index indicating an application. For example, in the case where the index indicating an application indicates an application including voice conversation, it is possible that the selecting unit 303 does not at all select the coding unit ranked higher or selects the coding unit ranked higher less frequently than in the opposite case.

Figure 6:
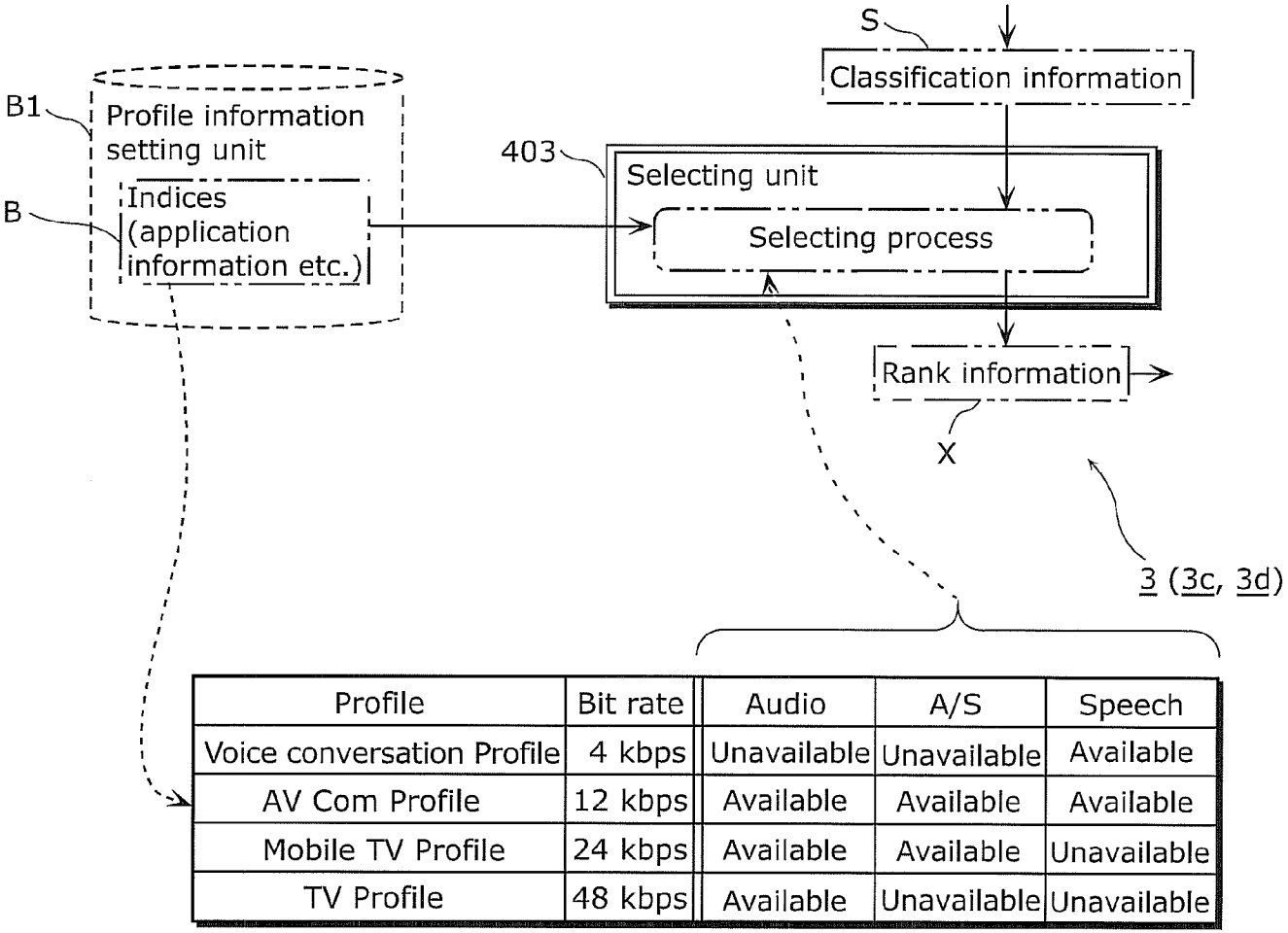
[FIG. 6]

FIG. 6 is a diagram showing a table (the lower portion of FIG. 6) of profile information (index B).

Each of profiles such as "Voice Conversation Profile" shown in the first column in the table at the lower portion of FIG. 6 is one of profiles in the USAC Standard with detailed specifications. One of these profiles is identified by the index B that is profile information (application information).

For example, the "Voice Conversation Profile" is a profile suitable for voice conversation using a mobile phone or a wired telephone. In addition, "AV Com Profile" is a profile suitable for communication through a video telephone. In addition, "Mobile TV Profile" is a profile suitable for one-segment television broadcasting, and "TV Profile" is a profile suitable for full-segment television broadcasting.

It is to be noted that one or some of the profiles such as the "Voice Conversation Profile" may be, for example, a profile to be specified as a part of a standard in mobile phone communication and to be referred to.

Each of the third to fifth columns (Audio, Audio/Speech (A/S), Speech) in the table of FIG. 6 shows availability of the corresponding one of the coding units which is available or unavailable by the selecting unit 303 (selector 403) in the profile shown in the corresponding row. For example, "available" in the third column indicates that the audio signal coding unit 300 is an available coding unit, and "available" in the fifth column indicates that the speech signal coding unit 301 is an available coding unit.

In the profile for a high bit rate (for example, 48 kbps (the fifth row and the second column), the coding unit ranked low (the audio signal coding unit 300, the fifth row and the third column) is the available coding unit, and the coding unit ranked high (the speech signal coding unit 301, the fifth row and the fifth column) is not the available coding unit. On the other hand, in the profile for a low bit rate (for example, 4 kbps (the second row and the second column), the coding unit ranked low (the second row and the third column) is not the available coding unit, and the coding unit ranked high (the speech signal coding unit 301, the second row and the fifth column) is the available coding unit. In addition, in the profile for an intermediate bit rate (for example, 12 kbps (the third line and the second column)), both of the coding unit (the speech signal coding unit 301, the second row and the fifth column) in the case of a lower bit rate) and the coding unit (the audio signal coding unit 300, the fifth row and the third column) are available coding units (the third line, and the third column and the fifth column).

The selecting unit 303 selects an available coding unit from among the one or more available coding units included in the coding units, for the profile identified by the obtained index B, and does not select any unavailable coding unit. For example, the selecting unit 303 generates rank information X for identifying the rank of the selected available coding unit, and causes the coding unit for use identified by the generated rank information X to code the signal to be coded.

The fourth column in the table of FIG. 6 is described in detail later.

Here, for example, the audio coding apparatus 3*c* (audio coding apparatus 3, FIG. 3, FIG. 5, and FIG. 6) may include a profile information setting unit B1 (FIG. 6) for setting and storing an index B obtained from the selecting unit 303.

In this way, it is possible to easily and appropriately select the appropriate coding unit based on the profile.

Here, the index input to the selecting unit 303 may be an index indicating the number of channels of the signal to be coded. In other words, the selecting unit 303 selects the coding unit ranked high more frequently in the case where the number of channels is larger than in the opposite case. When the number of channels of the input signal is large, it is conceivable that an application is for coding rich content. Thus, it is better not to consider only a speech signal is largely contained.

In this way, the index B may be used which is for identifying the bit rate (the second column) in the indicated application (the profile type: the first column in the table of FIG. 6).

The two coding units ranked first to second are used as coding units to describe operations according to this embodiment. However, coding units are not limited thereto.

Figure 4:
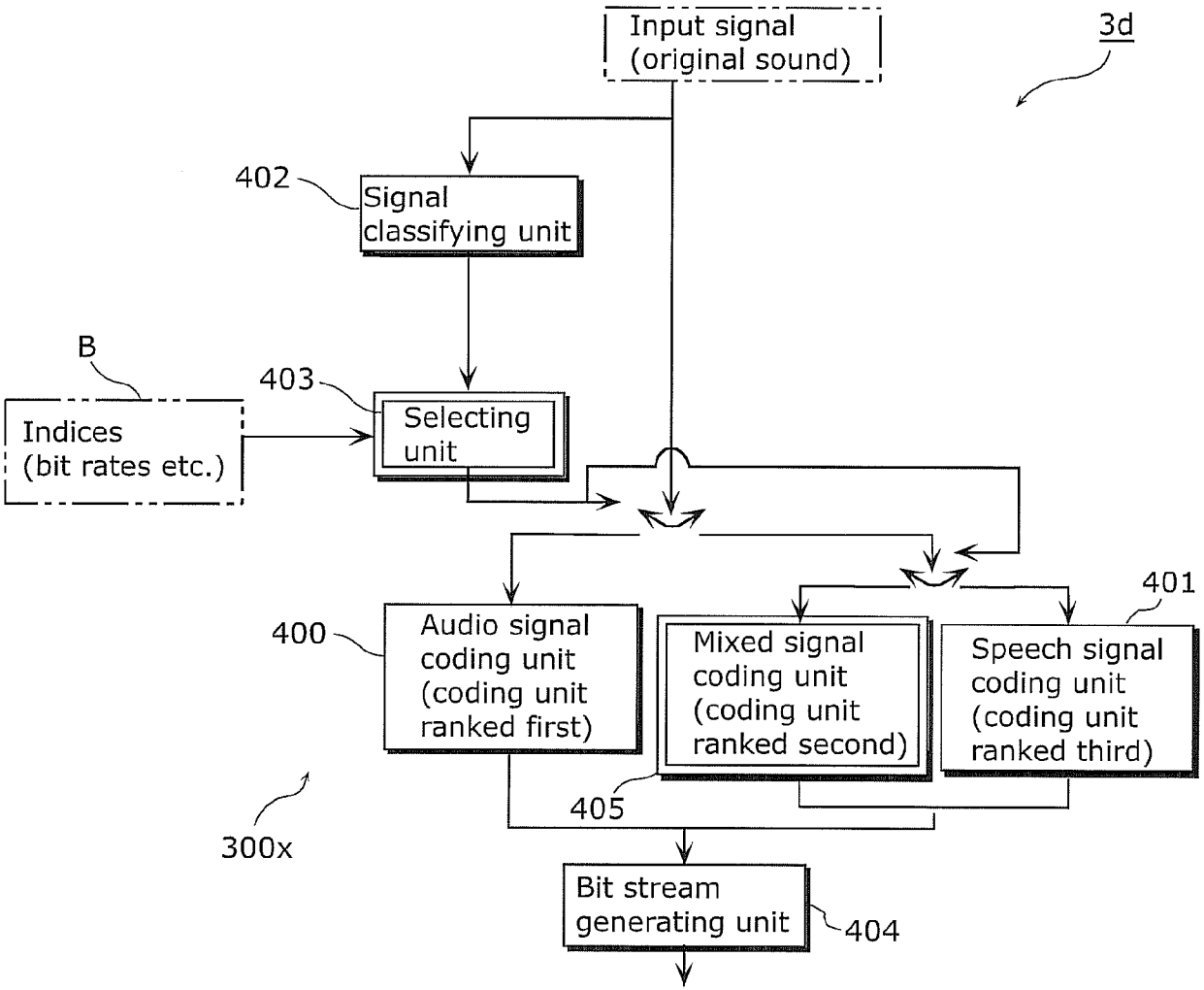
[FIG. 4]

FIG. 4 is a diagram showing an audio coding apparatus 3*d* (audio coding apparatus 3 (FIG. 5)) using three coding units ranked first to third as such coding units. The audio coding apparatus in FIG. 4 is structurally different from the audio coding apparatus in FIG. 3 in the points of further comprising a mixed signal coding unit 405 and the selecting unit 403 and selecting one of the coding units ranked first to third. The other structural elements may be, for example, the same as the corresponding structural elements in FIG. 3. Here, the coding unit ranked first is an audio signal coding unit 400, the coding unit ranked second is the mixed signal coding unit 405, and the coding unit ranked third is a speech signal coding unit 401.

In the case of the audio coding apparatus configured in this way, the selecting unit 403 selects an appropriate one of the three coding units based on information (classification information) S from the signal classifying unit 402 and an index B input separately.

In the case where the variable S is comparatively small (in the case where the containment degree of a speech signal in the input signal is small), the selecting unit 303 selects a coding unit ranked high (the coding unit ranked first in this embodiment, that is, the audio signal coding unit 400). In addition, in the case where the value of information S is larger (the input signal contains a large amount of a speech signal component), the selecting unit 403 selects the coding unit ranked high (the coding unit ranked third, that is, the speech signal coding unit 401 in this embodiment). In the case of an intermediate value, the selecting unit 403 selects the mixed signal coding unit 405 (selects the coding unit ranked second in this embodiment).

However, in the case where the coded bit rate indicated by the index B is high, the selecting unit 403 selects the coding unit ranked high more frequently.

More specifically, as an example, in the case where the index B is 24 kbps, the selecting unit 403 selects for use the audio signal coding unit 400 when information S is 3 or smaller, selects for use the mixed signal coding unit 405 when a variable S is larger than 3 and equal to or smaller than 7, and selects for use the speech signal coding unit 401 when a variable S is larger than 7.

As another example, in the case where the index B is 32 kbps, the selecting unit 403 selects for use the audio signal coding unit 400 when a variable S is 5 or smaller, selects for use the mixed signal coding unit 405 when a variable S is larger than 5 and equal to or smaller than 9, and selects for use the speech signal coding unit 401 when a variable S is larger than 9.

As another example, in the case where the index B is 48 kbps, the selecting unit 403 selects for use the audio signal coding unit 400 when a variable S is 7 or smaller, selects for use the mixed signal coding unit 405 when a variable S is larger than 7, and not to select for use the speech signal coding unit 401 irrespective of the variable S.

On the other hand, in the case where the index B is 12 kbps, the selecting unit 403 selects for use the mixed signal coding unit 405 when a variable S is 3 or smaller, selects for use the speech signal coding unit 401 when a variable S is larger than 7, and not to select for use the audio signal coding unit 400 irrespective of the variable S.

In addition, it is also good for the selecting unit 403 not to use the coding unit ranked third (speech signal coding unit 401) in the case where the application of the coded signal is an application such as broadcasting and music distribution which require comparatively high sound quality higher than a certain level. In addition, it is also good for the selecting unit 403 not to use the coding unit ranked first (audio signal coding unit 400) in the case where the application of the coded signal is an application including conversation.

Here, the mixed signal coding unit 405 is a coding unit which divides an input signal into a linear prediction coefficient and an excitation signal, and codes each of the linear prediction coefficient and the excitation signal. The mixed signal coding unit 405 codes the excitation signal by coding a frequency axis signal corresponding to the excitation signal.

Whether or not the mixed signal coding unit 405 is available or not is shown in the fourth column in the table of FIG. 6. Operations according to the details in the fourth column in the table of FIG. 6 may be performed. More specifically, for example, the selecting unit 403 may select, as the available coding unit, the available coding unit which supports the profile indicated by the index B from among the three coding units, based on the index B. The selecting unit 403 may cause the selected available coding unit selected based on the profile from among the three coding units to code the signal to be coded.

For example, the audio coding apparatus may be configured to comprise: a coding unit ranked first (an audio signal coding unit 400) which codes a frequency spectrum signal of the input signal; a coding unit ranked N (2<N) (a speech signal coding unit 401) which divides the input signal into a linear prediction coefficient and an excitation signal, and codes each of the linear prediction coefficient and the excitation signal (more specifically, a time axis signal of the excitation signal); and a coding unit ranked M (1<M<N) (mixed signal coding unit 405) which divides the input signal into a linear prediction coefficient and an excitation signal, and codes each of the linear prediction coefficient and the excitation signal (more specifically, a frequency axis signal of the excitation signal).

To sum up, this embodiment achieves the following object. In other words, this embodiment relates to audio coding apparatuses and audio decoding apparatuses which can achieve a high sound quality with a low bit rate. The object is to provide an audio coding apparatus (audio coding apparatus 3*c* or the like) and an audio decoding apparatus (audio decoding apparatus 1*a* or the like) which provide an excellent sound quality even when an input signal is a voice signal (a human voice) or a non-voice signal (a music tone, a natural sound, or the like). In order to achieve the object, an audio decoding apparatus is configured to comprise: a decoding unit group composed of a plurality of decoding units each of which is paired with a corresponding one of coding schemes selectable in coding; a signal processing unit which processes an output signal of one (the decoding unit for use) of the decoding units; an information transmitting unit which transmits, to the signal processing unit, information indicating which one (the decoding unit for use) of the decoding units in the decoding unit group is used.

Details of the audio coding apparatus 3*c* may be described below. It is to be noted that the following description is a mere example.

The audio coding apparatus 3*c* comprises a plurality of coding units (coding units 300*x*), a signal classifying unit (a signal classifying unit 302), and a selecting unit (a selecting unit 303).

The signal classifying unit identifies the amount of speech component 7M (classification information S) included in the input signal (the signal to be coded 7P), from among a plurality of amounts.

One of the plurality of amounts is a predetermined specific amount (for example, S=6).

The plurality of coding units includes the specific coding unit (speech signal coding unit 301). The specific coding unit is the optimum among the plurality of coding units in the case where a first bit rate (for example, 24 kbps) is used to code the signal to be coded including a speech component in an amount that is the specific amount, but is not the optimum in the case where a second bit rate (for example, 32 kbps) is used instead.

Each of the coding units codes the signal to be coded when the coding unit is the coding unit for use.

The selecting unit selects the specific coding unit (speech signal coding unit 301) as the coding unit for use when the bit rate of the coded signal indicated by the index (index B) is the first bit rate (24 kbps) in the case where the amount specified by the signal classifying unit is the specific amount of 6. The selecting unit does not select the specific coding unit as the coding unit for use in the case of the second bit rate (32 kbps). In the case of the latter, one of the other coding units is selected.

In this way, it is possible to reliably select an appropriate coding unit as the coding unit for use when the amount of the speech component is the specific amount.

In short, the selecting unit selects the specific coding unit only when the bit rate is the first bit rate in the case where the amount of the speech component is the specific amount, and selects the one of the other coding units when the bit rate is the second bit rate. In this way, it is possible to reliably select the appropriate coding unit irrespective of the bit rate.

For example, operations in this audio coding apparatus (audio coding apparatus 3) is as specifically described below.

Each of the coding units codes the input signal when the coding unit is the coding unit for use.

The plurality of coding units include the specific coding unit (speech signal coding unit 301) which codes the input signal most appropriately among the coding units when the bit rate of the coded signal is a predetermined bit rate (a bit rate in the range 91*a*).

Here, for example, the coded signal coded most appropriately has comparatively high evaluation values of the data amount and sound quality, as described earlier.

The selecting unit selects, as the coding unit for use, the coding unit (audio signal coding unit 502) other than the specific coding unit only in the case where the bit rate is not the specific bit rate, from among the cases of the specific bit rate (the bit rate in the range 91*a*) and a non-specific bit rate (in the range 90 or the range 91*b*).

For example, this is described in detail below.

The plurality of coding units include the specific coding unit (speech signal coding unit 301) which codes the input signal most appropriately among the coding units when the bit rate of the coded signal is a predetermined specific bit rate (24 kbps) (and information S is 6).

The selecting unit selects, as the coding unit for use (in the case where a variable S is 6), the coding unit (audio signal coding unit 300) other than the specific coding unit only in the case where the bit rate is not the specific bit rate, from among the cases of the specific bit rate (24 kbps) and a non-specific bit rate (for example, 32 kbps).

This is described in detail below.

The specific coding unit is not the most appropriate one in the coding of the input signal in the case where the input signal is a specific input signal (that is an input signal in the case where a variable S is 5 or smaller) even when the bit rate of the coded signal is the specific bit rate (24 kbps).

The signal classifying unit identifies that the input signal is the specific input signal (a variable S is 5 or smaller).

The selecting unit selects the other coding unit (audio signal coding unit 300) in the case where the signal classifying unit identifies the input signal as the specific input signal (information S is 5 or smaller) even when the bit rate of the coded signal is the specific bit rate (24 kbps).

The specific input signal is the input signal including the specific amount (a variable S is 5 or smaller) of the speech component.

The signal classifying unit identifies the amount (S) of the speech component included in the input signal.

The selecting unit identifies a threshold value, selects, as the coding unit for use, the one (audio signal coding unit 300) of the other coding units when the identified threshold value is equal to or larger than the amount identified by the signal classifying unit, and selects the specific coding unit (speech signal coding unit 301) when the identified threshold value is smaller than the identified amount. The selecting unit identifies a threshold value of 5 larger than the specific amount (a variable S is 5 or larger) when the bit rate of the coded signal is the specific bit rate (24 kbps).

For example, an audio signal processing system 4 may be an audio signal processing system conforming to the USAC Standard and comprise an audio coding apparatus 3*c* (audio coding apparatus 3*d*) as the audio coding apparatus 3 and an audio decoding apparatus 1*a* (audio decoding apparatus 1*b*) as the audio decoding apparatus 1.

In this audio signal processing system 4, the audio decoding apparatus 1 executes a post-decoding process using a comparatively appropriate scheme. In addition, the audio coding apparatus 3 reliably selects an appropriate coding scheme, which makes it possible to reliably execute the post-decoding process using the appropriate scheme.

The audio coding apparatus 3*c* (audio coding apparatus 3*d*) and the audio decoding apparatus 1*a* (audio decoding apparatus 1*b*) can be used as two components which constitute this audio signal processing system 4, and are closely related to each other. In other words, the audio signal processing system 4, the audio coding apparatus 3, and the audio decoding apparatus 1 are techniques related to each other in terms of the advantageous effects, and belong to a single technical field. Here, for example, tools such as a bolt and a nut and a connecting tool composed of the bolt and the nut are assumed to be in a signal technical field. The audio signal processing system 4 corresponds to the whole connecting tool, the audio coding apparatus 3 and audio decoding apparatus 1 correspond to the bolt and the nut.

The present invention is not limited to the above-described embodiments. Those skilled in the art will readily appreciate that many modifications are possible in the exemplary embodiments and other embodiments are possible by arbitrarily combining the structural elements of the embodiments without materially departing from the novel teachings and advantageous effects of the present invention. Accordingly, all of the modifications and other embodiments are intended to be included within the scope of the present invention.

The embodiments described above are exemplary in all respects, and should be interpreted as not limiting the present invention. The scope of the present invention is defined by the Claims of the present application not by the DESCRIPTION of the present application, and all possible modifications having equivalents to those in the Claims and within the scope of the Claims are intended to be included in the scope of the present invention.

The design considerations in the embodiments may be publicly known techniques, or modified versions of publicly known techniques.

For example, the following operations may be performed in the present invention or in an aspect of the present invention. The following operations are also mere examples.

The audio signal processing system 4 (FIG. 5) may be a system conforming to USAC.

It is possible to perform decoding (using an audio signal decoding unit 102, S4) according to an audio codec when predetermined information 7I (FIG. 1) indicates that the codec used to code a coded signal 7C is an audio codec among the audio codec and a speech codec.

It is possible to perform decoding (using a speech signal decoding unit 103, S4) according to the speech codec when predetermined information 7I indicates that the codec used to code a coded signal 7C is the speech codec.

Subsequently, it is possible to perform a replication process (using a band replicating unit 104, S6) on the band for a decoded signal 7A decoded in conformance to the codec indicated by the information 7I to generate a processed signal 7L.

The information 7I may be transmitted when generating the processed signal 7L, and the transmitted information 7I may be obtained (by the band replicating unit 104) (S5). In the case where the information 7I indicates the audio codec, it is possible to generate the processed signal 7L (a first processed signal 7L1, S6) according to the first scheme other than the second scheme.

It is possible to generate the processed signal 7L (a second processed signal 7L2, S6) according to a second scheme when the information 7I indicates the speech codec.

Here, it is good that the second scheme is not available when decoding is performed according to the audio codec, and is available only when decoding is performed according to the speech codec, and that the second scheme is used to generate the second processed signal 7L2 that is more appropriate than the first processed signal 7L1 which is generated according to the first method.

For example, as described earlier, the second scheme may be a scheme for calculating the envelope characteristic from a linear prediction coefficient and an excitation signal, and generating, as a processed signal 7L having a band resulting from the replication, a second processed signal L2 identified based on the calculated envelope characteristic (see Patent Literature 1: Japanese Patent Publication No. 3189614 etc.).

In this way, it is possible to generate the more appropriate second processed signal 7L2, as the processed signal 7L.

Furthermore, mere information 7I indicating a codec used in decoding is also used in the post-decoding process without requiring any additional information, which simplifies the post-decoding process.

For this reason, it is possible to achieve both generation of the appropriate processed signal 7L and simplification of the post-decoding process.

More specifically, for example, it is also good to prepare a storage unit for storing the information 7I until the processed signal 7L is generated and thereby allowing the use of the information 7I in the generation of the processed signal 7L. This storage unit may be, for example, a part of an information transmitting unit 101.

Alternatively, it is also good to prepare a transmission line (transmission media) 7X (FIG. 1) for transmitting the information 7I to the band replicating unit 104 etc. via the transmission line 7X.

Each of the functional blocks such as the functional blocks in FIG. 1 may be functional blocks implemented in a computer and exerts its function when software is executed by the computer, or may be functional blocks implemented in an operation circuit without software.

Here, it is also good to generate classification information S (FIG. 3) (using a signal classifying unit 302, S1) indicating whether the amount of a speech component 7M included in a signal to be coded 7P (FIG. 3) is larger than a threshold value or not (see (1) and (2) in FIG. 11).

It is possible to select the speech signal coding unit 301 (selecting unit 303, S2) in the case where the classification information S indicates that the amount of the speech component 7M included in the signal to be coded 7P (FIG. 3) is larger than the threshold value (for example, in the case of (2) in FIG. 11).

It is possible to perform coding according to the speech codec (using the speech signal coding unit 301, S3) in the case where the speech signal coding unit 301 is selected.

However, the coded signal 7T may be, for example, the earlier-mentioned coded signal 7C (input signal 7S, FIG. 1).

As described earlier, the second processed signal 7L2 that is more appropriate is generated when the codec of the coded signal 7C (FIG. 1) is the speech codec.

It is also good to select the speech signal coding unit 301 (selecting unit 303, S2) not only when the classification information S indicates that the amount of the speech component 7M is larger than the threshold value, but also when the classification information S indicates that the amount of the speech component 7M is smaller than the threshold value ((1) in FIG. 11).

In this way, it is possible to generate the more appropriate second processed signal 7L2.

However, there is a case where the bit rate shown by the index B is a bit rate within the range 91*a*, and a case where the bit rate (in the range 90, or in the range 91*b*) other than the range 91*a*.

In the case where the bit rate shown by the index B is outside the range 91*a* (in the range 90, or in the range 91*b*), the coded signal coded according to the speech codec (data 74A) has a low sound quality (see data 74A, 74S).

In the opposite case where the bit rate shown by the index B is within the range 91*a*, the coded signal coded according to the speech codec (data 74A in FIG. 11) has a high sound quality.

Thus, it is possible to obtain the index B indicating the bit rate (selecting unit 303, S2).

In the case where the amount of the speech component 7M is smaller than the threshold value ((1) in FIG. 11), the following processing may be performed.

In the processing, the selecting unit may select the speech signal coding unit 301 (data 74A) only when the index B indicates a bit rate within the range 91*a*, and may select the audio signal coding unit 300 when the index B indicates a bit rate outside the range 91*a* (in the range 90 or in the range 91*b*).

In this way, it is possible to code the input signal (using the speech signal coding unit 301, S3) according to the speech codec only when the bit rate within the range 91*a* is shown, and to code the input signal (using the audio signal coding unit 300, S3) when the bit rate outside the range 91*a* is shown.

In this way, it is possible to perform coding according to the speech codec to reliably generate the appropriate second processed signal 7L2 when the index B indicates the bit rate within the range 91*a*.

Furthermore, it is possible to enhance the sound quality by performing coding according to the audio codec when the index B does not indicate a bit rate within the range 91*a*.

In this way, it is possible to achieve both the reliable generation of the more appropriate second processed signal 7L2 and a high sound quality.

As described earlier, for example, it is also good to perform processing according to the index B also in the case where the amount of the speech component 7M is larger than the threshold value ((2) in FIG. 11).

In this way, the audio signal processing system 4 in this embodiment comprising the audio decoding apparatus 1 and the audio coding apparatus 3 provides the both advantageous effects (FIG. 5, FIG. 12, etc.).

The audio decoding apparatus 1 and the audio coding apparatus 3 are available as components for providing the both advantageous effects, and belong to the signal technical field.

The audio coding apparatus may be configured to comprise: the plurality of coding units (i) each of which codes the input signal to generate the coded signal when the coding unit is the coding unit for use, (ii) which includes the specific coding unit which codes the input signal most appropriately than any other remaining coding units when the bit rate of the coded signal is the predetermined specific bit rate; and the selecting unit which selects one of the coding units which is other than the specific coding unit as the coding unit for use only in the case where the bit rate of the coded signal is not the specific bit rate from among the cases where the bit rate of the coded signal is the specific bit rate and not the specific bit rate (see the earlier-given description).

More specifically, it is possible that the specific coding unit is not the most appropriate coding unit in the coding of the input signal in the case where the input signal is the specific input signal even when the bit rate of the coded signal is the specific bit rate, that the signal classifying unit identifies that the input signal is the specific input signal, and that the selecting unit selects the other coding unit when the signal classifying unit identifies that the input signal is the specific input signal even when the bit rate of the coded signal is the specific bit rate (see the earlier-given description).

It is to be noted that a plurality of technical considerations described separately above may be arbitrarily combined. In addition, a method comprising at least one of appropriate processes described above may be realized. Furthermore, an integrated circuit having at least one of functions described above may be configured. In addition, a computer program for causing a computer to execute the function may be realized. Furthermore, a data structure and the like of the data of the computer program may be generated.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

Industrial Applicability

An audio decoding apparatus according to the present invention comprises: a decoding unit group composed of a plurality of decoding units corresponding to a plurality of coding schemes selectable in coding; a signal processing unit which processes an output signal of the decoding unit; and an information transmitting unit which transmits, to the signal processing unit, information indicating which one of the decoding units in the decoding unit group is used, wherein the signal processing unit processes the signal according to the information from the information transmitting unit, using a scheme selected from among a plurality of methods different from each other. For this reason, it is possible to generate an optimum decoded signal according to a property of an input coded signal (whether the coded signal is a speech signal or an audio signal). Thus, the present invention is applicable to a wide variety of apparatuses ranging from mobile terminals to large Audio Visual (AV) apparatuses such as digital television sets.

The audio coding apparatus according to the present invention comprises: a plurality of coding units ranked from first to Nth (N>1); a signal classifying unit which classifies an input signal according to a property of an input signal; and a selecting unit which selects which one of the plurality of coding units should be used, wherein the selecting unit selects one of the coding units according to an output by the signal classifying unit and a pre-specified index. For this reason, it is possible to code signals ranging from speech signals to audio signals to have a high sound quality with a comparatively low bit rate by coding the input signals according to optimum coding schemes. Therefore, the present invention is applicable to a wide variety of apparatuses ranging from mobile terminals to large Audio Visual (AV) apparatuses such as digital television sets.

More specifically, it is possible to enhance the quality of processed signals with the audio coding apparatus and the audio decoding apparatus each having a simple structure. Furthermore, it is possible to reliably maintain a high sound quality, not only to increase the quality of the processed signal.

The invention claimed is:

1. An audio coding apparatus comprising:

coding units;

a signal classifying unit configured to determine a classification of a property of an input signal as a classification of the input signal, according to the property; and a selecting unit configured to select a coding unit based on the classification determined by said signal classifying unit and an index specified for said selecting unit, irrespective of the property of the input signal, from among said coding units and cause said selected coding unit to code the input signal, wherein:

said coding units are ranked from first to Nth, N being greater than 1 and a lower number indicating a higher rank, the index indicates a bit rate of a coded signal to be generated from the input signal by said coding unit, the classification includes a value S which increases as a degree of speech signal components in the input signal increases, a lowest coding unit that is ranked first is configured to code a frequency spectrum signal of the input signal, a highest coding unit that is ranked Nth is configured to separate the input signal into a linear prediction coefficient and an excitation signal, and code each of the linear prediction coefficient and the excitation signal, and said selecting unit is configured to:

select, from the coding units, a coding unit that is ranked higher than a predetermined rank, when (i) the bit rate indicated by the index is a first bit rate and (ii) the value S is smaller than or equal to a predetermined value A; and select, from the coding units, a coding unit that is ranked higher than the predetermined rank, when (i) the bit rate indicated by the index is a second bit rate higher than the first bit rate and (ii) the value S is smaller than or equal to a predetermined value B, the predetermined value B being larger than the predetermined value A.

2. The audio coding apparatus according to claim 1, wherein:

N is greater than 2, and a middle coding unit that is ranked Mth (1<M<N) is configured to separate the input signal into a linear prediction coefficient and an excitation signal, and code each of the linear prediction coefficient and a frequency axis signal of the excitation signal.

3. The audio coding apparatus according to claim 1, wherein:

said selecting unit is configured to select the coding unit more frequently when the bit rate indicated by the index is the first bit rate than when the bit rate indicated by the index is the second bit rate.

4. The audio coding apparatus according to claim 1, wherein:

said selecting unit is configured to select the coding unit less frequently when the index indicates that the input signal involves voice conversation than when the index does not indicate that the input signal involve any voice conversation.

5. The audio coding apparatus according to claim 1, wherein:

said coding units include a specific coding unit, and said selecting unit is configured to select one of said coding units which is other than said specific coding unit when the bit rate indicated by the index is not a specific bit rate, and select said specific coding unit when the bit rate is the specific bit rate, the specific bit rate being a predetermined bit rate at which said specific coding unit codes the input signal most suitably among said coding unit.

6. The audio coding apparatus according to claim 5, wherein:

said signal classifying unit is configured to determine the input signal to be a specific input signal, the specific input signal being a signal at which said specific coding unit does not code the input signal most suitably among said coding signal even when the bit rate is the specific bit rate, and said selecting unit is configured to select one of said coding units other than said specific coding unit when said signal classifying unit determines the input signal is the specific input signal even when the bit rate of the coded signal is the specific bit rate.

7. The audio coding apparatus according to claim 1, wherein:

N is greater than 2, and said selecting unit is configured to select, from the coding units, a coding unit that is ranked higher than the predetermined rank irrespective of the value S when the bit rate indicated by the index is a third bit rate higher than the second bit rate.

8. The audio coding apparatus according to claim 1, wherein said selecting unit is further configured to select, from the coding units, a coding unit that is ranked equal to or lower than the predetermined rank, when (i) the bit rate indicated by the index is the first bit rate and (ii) the value S is larger than the predetermined value A.

9. An audio signal processing system conforming to the Unified Speech and Audio Codec (SAC) standard, said system comprising:

an audio decoding apparatus; and an audio coding apparatus including:

coding units;

a signal classifying unit configured to determine a classification of a property of an input signal as a classification of the input signal according to the property; and a selecting unit configured to select a coding unit based on the classification determined by said signal classifying unit and an index specified for said selecting unit irrespective of the property of the input signal from said coding units, and causes said selected coding unit to code the input signal, wherein:

said respective coding units are ranked from first to Nth, N being greater than 1 and a lower number indicating a higher rank, the index indicates a bit rate of a coded signal to be generated from the input signal by said coding unit, the classification includes a value S which increases as a degree of speech signal components in the input signal increases, a lowest coding unit that is ranked first is configured to code a frequency spectrum signal of the input signal, a highest coding unit that is ranked Nth is configured to separate the input signal into a linear prediction coefficient and an excitation signal, and code each of the linear prediction coefficient and the excitation signal, and said selecting unit is configured to:

select, from the coding units, a coding unit that is ranked higher than a predetermined rank, when (i) the bit rate indicated by the index is a first bit rate and (ii) the value S is smaller than or equal to a predetermined value A; and select, from the coding units, a coding unit that is ranked higher than the predetermined rank, when (i) the bit rate indicated by the index is a second bit rate higher than the first bit rate and (ii) the value S is smaller than or equal to a predetermined value B, the predetermined values B being larger than the predetermined value A.

10. The audio signal processing system according to claim 9, wherein:

said coding units include a specific coding unit, and said selecting unit is configured to select one of said coding units which is other than said specific coding unit when the bit rate indicated by the index is not a specific bit rate, and select said specific coding unit when the bit rate is the specific bit rate, the specific bit rate being a predetermined bit rate at which said specific coding unit codes the input signal most suitably among said coding unit.

11. An audio coding apparatus comprising:

coding units;

a signal classifying unit configured to determine a classification of a property of an input signal as a classification of the input signal, according to the property; and a selecting unit configured to select a coding unit based on the classification determined by said signal classifying unit and an index specified for said selecting unit, irrespective of the property of the input signal, from among said coding units, and cause said selected coding unit to code the input signal, wherein:

said respective coding units are ranked from first to Nth, N being greater than 1 and a lower number indicating a higher rank, the index indicates an application of a coded signal to be generated from the input signal by said coding unit, the classification includes a value S which increases as a degree of speech signal components in the input signal increases, a lowest coding unit ranked first is configured to code a frequency spectrum signal of the input signal, a highest coding unit ranked Nth is configured to separate the input signal into a linear prediction coefficient and an excitation signal, and code each of the linear prediction coefficient and the excitation signal, and said selecting unit is configured to:

select, from the coding units, a coding unit that is ranked higher than a predetermined rank, when (i) the application indicated by the index involves voice conversation and (ii) the value S is smaller than or equal to a predetermined value A; and select, from the coding units, a coding unit that is ranked higher than the predetermined rank, when (i) the application indicated by the index does not involve voice conversation and (ii) the value S is smaller than or equal to a predetermined value B, the predetermined value B being larger than the predetermined value A.

12. An audio signal processing system conforming to the Unified Speech and Audio Codec (SAC) standard, said system comprising:

an audio decoding apparatus; and an audio coding apparatus including:

coding units;

a signal classifying unit configured to determine a classification of a property of an input signal as a classification of the input signal, according to the property; and a selecting unit configured to select a coding unit based on the classification determined by said signal classifying unit and an index specified for said selecting unit, irrespective of the property of the input signal, from among said coding units, and cause said selected coding unit to code the input signal, wherein:

said respective coding units are ranked from first to Nth, N being greater than 1 and a lower number indicating a higher rank, the index indicates an application of a coded signal to be generated from the input signal by said coding unit, the classification includes a value S which increases as a degree of speech signal components in the input signal increases, a lowest coding unit ranked first is configured to code a frequency spectrum signal of the input signal, a highest coding unit ranked Nth is configured to separate the input signal into a linear prediction coefficient and an excitation signal, and code each of the linear prediction coefficient and the excitation signal, and said selecting unit is configured to:

select, from the coding units, a coding unit that is ranked higher than a predetermined rank, when (i) the application indicated by the index involves voice conversation and (ii) the value S is smaller than or equal to a predetermined value A; and select, from the coding units, a coding unit that is ranked higher than the predetermined rank, irrespective of the value S when the application indicated by the index does not involve voice conversation.

* * * * *